US011805911B2

(12) United States Patent
Milberg et al.

(10) Patent No.: US 11,805,911 B2
(45) Date of Patent: Nov. 7, 2023

(54) KNOCK-DOWN FURNITURE

(71) Applicant: SOFAWEB.COM INC., Concord (CA)

(72) Inventors: Jordan Milberg, Concord (CA); Matthew Milberg, Concord (CA)

(73) Assignee: SOFAWEB.COM INC., Concord (CA)

( * ) Notice: Subject to any disclaimer, the term of this patent is extended or adjusted under 35 U.S.C. 154(b) by 0 days.

(21) Appl. No.: 17/961,737

(22) Filed: Oct. 7, 2022

(65) Prior Publication Data

US 2023/0108550 A1 Apr. 6, 2023

Related U.S. Application Data

(63) Continuation of application No. 17/248,899, filed on Feb. 12, 2021, now Pat. No. 11,464,339.

(60) Provisional application No. 62/976,970, filed on Feb. 14, 2020.

(51) Int. Cl.
*A47C 13/00* (2006.01)
*A47C 4/02* (2006.01)

(52) U.S. Cl.
CPC ..... *A47C 4/021* (2013.01); *A47C 4/028* (2013.01); *A47C 13/005* (2013.01)

(58) Field of Classification Search
CPC ..... A47C 13/005; A47C 4/021
See application file for complete search history.

(56) References Cited

U.S. PATENT DOCUMENTS 3,973,800 A 8/1976 Kogan
5,738,414 A 4/1998 Wieland et al.
5,931,529 A 8/1999 LaPointe et al.
6,241,317 B1 6/2001 Wu
7,240,967 B2 7/2007 Wade
9,668,581 B1 6/2017 Hill
D817,057 S 5/2018 Kohl
10,182,659 B2 1/2019 Kuhl et al.
2004/0095000 A1 5/2004 Durling
2005/0146179 A1 7/2005 Murphy
2006/0033368 A1 2/2006 Longnecker
2010/0244537 A1 9/2010 Chen
2012/0256464 A1 10/2012 Chang
(Continued)

FOREIGN PATENT DOCUMENTS

CN 204378597 U * 6/2015
DE 102020114675 A1 * 3/2021 ..... A47C 13/005
(Continued)

*Primary Examiner* — Timothy J Brindley

(74) *Attorney, Agent, or Firm* — BERESKIN & PARR LLP/S.E.N.C.R.L.,s.r.l.

(57) ABSTRACT

A kit of parts, shippable to an end user in boxes for assembly of the parts by the end user into seating furniture, includes seat bases and seat backs removably attachable to the seat bases; a first armrest with a channel connector having a first channel for slidably receiving a first slide member of a first seat base for securing the first armrest and the first seat base together; and a second armrest with at least a second slide member for slidable insertion into a second channel of another channel connector of a second seat base for securing the second armrest and the second seat base together. Each channel connector secured to the first seat base has a third channel for receiving a third slide member of a slide connector of any other seat base for securing together said other seat base and the first seat base.

21 Claims, 19 Drawing Sheets

(56) References Cited

U.S. PATENT DOCUMENTS

| | | | | |
|---|---|---|---|---|
| 2017/0071354 | A1 | 3/2017 | Mezzera | |
| 2018/0213943 | A1 | 8/2018 | Kuhl et al. | |
| 2020/0268160 | A1 | 8/2020 | Kuhl et al. | |
| 2021/0068547 | A1 | 3/2021 | Hodgson et al. | |
| 2022/0354261 | A1* | 11/2022 | Aubé | A47C 4/028 |

FOREIGN PATENT DOCUMENTS

| | | | |
|---|---|---|---|
| JP | 6265531 | B2 | 1/2018 |
| WO | 2005027687 | A2 | 2/2005 |
| WO | 2018140582 | A1 | 8/2018 |

* cited by examiner

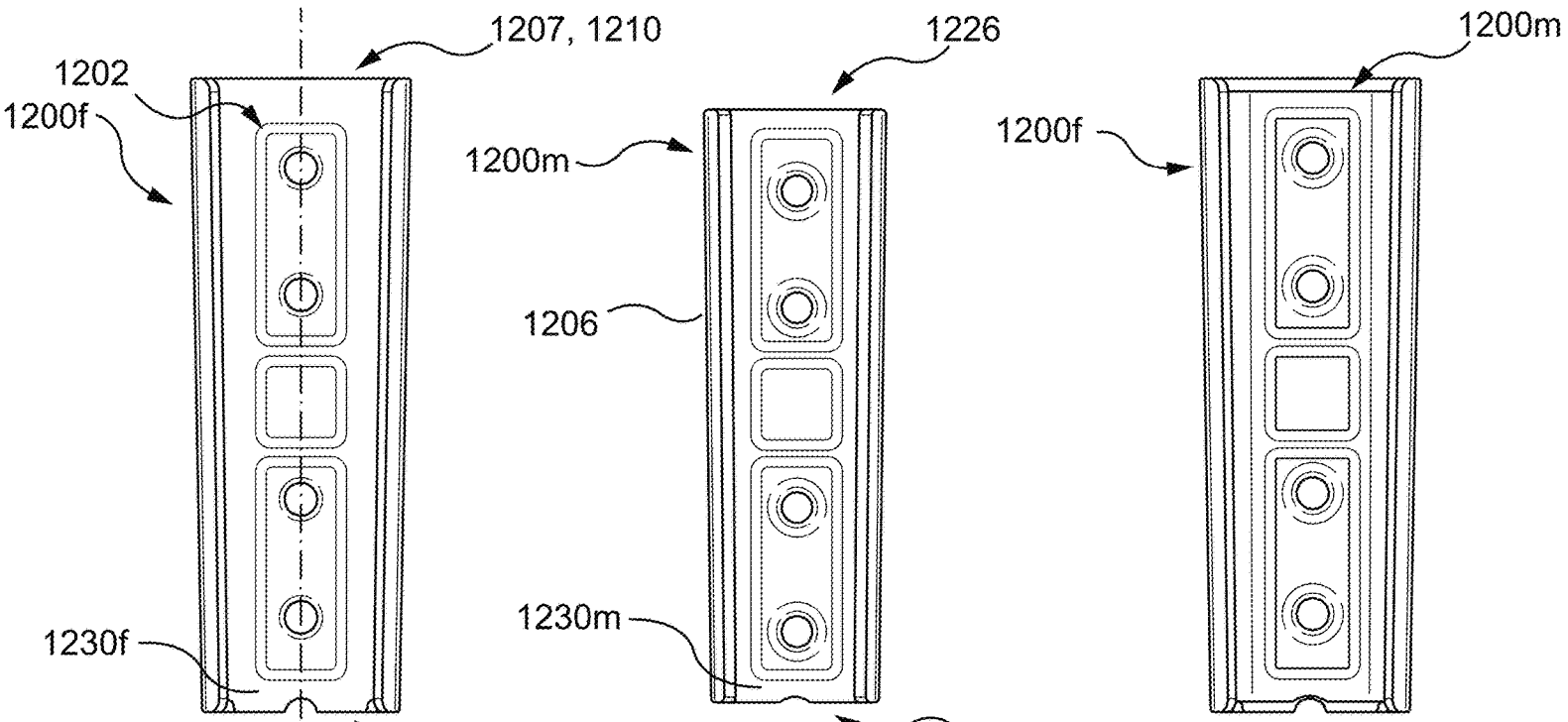
FIG. 29
FIG. 28
FIG. 27
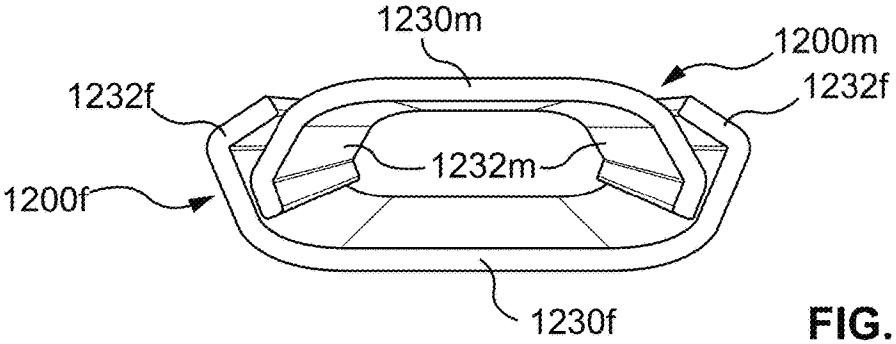
FIG. 30

KNOCK-DOWN FURNITURE

CROSS-REFERENCE TO RELATED APPLICATIONS

This application is a continuation of application Ser. No. 17/248,899, filed Feb. 12, 2021, which claims the benefit of U.S. Provisional Application No. 62/976,970 filed Feb. 14, 2020, the entirety of each of which is hereby incorporated herein by reference.

FIELD

The specification relates generally to furniture, and more specifically, to knock-down furniture assemblies and related methods.

BACKGROUND

U.S. Pat. No. 10,182,659 (Kuhl et al.) discloses a modular sofa assembly including a plurality of seating modules each having a seat section, a backrest section, and side edge surfaces. The backrest section includes first and second portions coupled for movement between a folded configuration and an extended configuration. An armrest module has an armrest side edge surface configured for mating engagement with a side edge surface of a seating module. The modular sofa is assembled by aligning connectors of the seating modules and armrest module, with each respective connectors slidingly engaged along an axis. After bringing the modules together, these connections are secured with the side edge surfaces in abutting engagement. The modular sofa further may include a power cradle mounted at the sofa's bottom surface. The power cradle includes a cubic power outlet near the front of the sofa, and power cable extending beyond the back of the sofa.

SUMMARY

The following summary is intended to introduce the reader to various aspects of the applicant's teaching, but not to define any invention.

According to some aspects, a knock-down furniture assembly includes (a) a seating assembly having a first end and a second end laterally opposite the first end, the first end including a plurality of first end connectors and the second end including a plurality of second end connectors; (b) a first arm having a first outboard side and a first inboard side laterally opposite the first outboard side, the first inboard side including a plurality of first arm connectors, each first arm connector and a corresponding first end connector defining a first pair of interlockable connectors for removably attaching the first arm to the first end of the seating assembly; and (c) a second arm having a second outboard side and a second inboard side laterally opposite the second outboard side, the second inboard side including a plurality of second arm connectors, each second arm connector and a corresponding second end connector defining a second pair of interlockable connectors for removably attaching the second arm to the second end of the seating assembly, wherein each pair of interlockable connectors comprises (i) a female bracket defining a bracket channel extending along a channel axis oriented generally vertically when the furniture assembly is upright, and (ii) a male bracket comprising a slide member slidable into the bracket channel generally along the channel axis for interlocking thereof.

In some examples, the bracket channel extends along the channel axis between a first channel end and a second channel end opposite the first channel end, the first channel end defining a channel opening oriented normal to the channel axis for insertion of the slide member into the bracket channel.

In some examples, the bracket channel has a channel length extending along the channel axis and a channel width tapering along the channel length at a first taper angle, and the slide member has a slide member length and a slide member width tapering along the slide member length at a second taper angle corresponding to the first taper angle for nesting of the slide member in the bracket channel.

In some examples, the male and female brackets of the first pair of interlockable connectors are identical to the male and female brackets of the second pair of interlockable connectors.

In some examples, the seating assembly comprises a plurality of modular seat sections removably attachable to each other in a sofa arrangement, each seat section having a first side and a second side laterally opposite the first side, the first side of a first one of the seat sections defining the first end of the seating assembly and the second side of a second one of the seat sections defining the second end of the seating assembly. In some examples, the seat sections are identical to each other to facilitate interchangeability therebetween. In some examples, the first side of each seat section includes a plurality of first side connectors and the second side of each seat section includes a plurality of second side connectors, each first side connector of any seat section interlockable with a corresponding second side connector of an adjacent seat section to define a third pair of interlockable connectors for removably attaching adjacent seat sections to each other.

In some examples, the first end connectors for attaching the first arm to the seating assembly comprise the first side connectors of the first one of the seat sections, and the second end connectors for attaching the second arm to the seating assembly comprise and the second side connectors of the second one of the seat sections. In some examples, each seat section includes: (i) a seat base having a front, a rear opposite the front, and a plurality of rear connectors adjacent the rear; and (ii) a seat back having a top, a bottom vertically opposite the top, and a plurality of bottom connectors adjacent the bottom, each bottom connector and a corresponding rear connector defining a fourth pair of interlockable connectors for removably attaching the seat back to the seat base to form the seat section. In some examples, the first and second side connectors of each seat section are on the seat base and the seat back is free of any of the first and second side connectors.

In some examples, the assembly further includes a plurality of latch mechanisms for further securing the first arm to the seating assembly, the second arm to the seating assembly, and each seat section to an adjacent seat section.

In some examples, the seating assembly comprises at least one modular seat section, the modular seat section including: (i) a seat base having a front, a rear opposite the front, and a plurality of rear connectors adjacent the rear; and (ii) a seat back having a top, a bottom vertically opposite the top, and a plurality of bottom connectors adjacent the bottom, each bottom connector and a corresponding rear connector defining a fourth pair of interlockable connectors for removably attaching the seat back to the seat base to form the modular seat section.

In some examples, the at least one modular seat section has a first side for defining the first end of the seating assembly, and a second side laterally opposite the first side for defining the second end of the seating assembly.

In some examples, the knock-down furniture assembly further includes a plurality of latch mechanisms for further securing the first arm to the first end of the seat assembly and the second arm to the second end of the seat assembly.

According to some aspects, a knock-down furniture assembly includes: (a) a seating assembly having a first end and a second end laterally opposite the first end, the first end including a plurality of first end connectors and the second end including a plurality of second end connectors, the seating assembly including at least one modular seat section, each modular seat section including: (i) a seat base having a front, a rear opposite the front, and an upwardly protruding portion at the rear defining a raised upper surface, the raised upper surface including a plurality of rear connectors; and (ii) a seat back having a top, a bottom vertically opposite the top, and a plurality of bottom connectors adjacent the bottom and alignable with the rear connectors of the seat base for removably attaching the seat back to the seat base to form the modular seat section. The furniture assembly further includes (b) a first arm having a first outboard side and a first inboard side laterally opposite the first outboard side, the first inboard side including a plurality of first arm connectors, each first arm connector and a corresponding first end connector defining a first pair of interlockable connectors for removably attaching the first arm to the first end of the seating assembly; and (c) a second arm having a second outboard side and a second inboard side laterally opposite the second outboard side, the second inboard side including a plurality of second arm connectors, each second arm connector and a corresponding second end connector defining a second pair of interlockable connectors for removably attaching the second arm to the second end of the seating assembly. Each first and second pair of interlockable connectors includes: (i) a female connector comprising a channel extending along a channel axis that is oriented generally vertically when the furniture assembly is upright; and (ii) a male connector comprising a slide member slidable into the channel along the channel axis for interlocking thereof.

In some examples, the channel extends along the channel axis between a first channel end and a second channel end disposed vertically below the first channel end, the first channel end defining a channel opening for insertion of the slide member into the channel.

In some examples, the female connectors each comprise a base plate and a pair of retaining flanges spaced apart from the base plate, the channel bounded laterally at least in part by the retaining flanges and the base plate.

In some examples, the male and female connectors of the first pair of interlockable connectors are identical to the male and female connectors of the second pair of interlockable connectors.

In some examples, the seating assembly comprises a plurality of the modular seat sections removably attachable to each other in a laterally side-by-side arrangement, each modular seat section having a first side and a second side laterally opposite the first side, the first side of a first one of the modular seat sections defining the first end of the seating assembly and the second side of a second one of the modular seat sections defining the second end of the seating assembly. In some examples, the modular seat sections are identical to each other to facilitate interchangeability therebetween. In some examples, the first side of each modular seat section includes a plurality of first side connectors and the second side of each modular seat section includes a plurality of second side connectors, each first side connector of any seat section interlockable with a corresponding second side connector of an adjacent seat section to define a third pair of interlockable connectors for removably attaching adjacent seat sections to each other, each third pair of interlockable connectors including another one of the female connectors and another one of the male connectors identical to the female and male connectors of the first pair and second pair of interlockable connectors.

In some examples, the first end connectors of the seating assembly comprise the first side connectors of the first one of the seat sections, and wherein the second end connectors of the seating assembly comprise the second side connectors of the second one of the seat sections. In some examples, the first and second side connectors of each modular seat section are mounted to the seat base and the seat back is free of any of the first and second side connectors to facilitate assembly of the seat backs to the seat bases after the adjacent seat sections have been attached together.

In some examples, the furniture assembly further includes a plurality of latch mechanisms each movable between unlatched and latched positions, the plurality of latch mechanisms including a plurality of first latch mechanisms for laterally urging together the first arm and the first one of the modular seat sections when in the latched position, and a plurality of second latch mechanisms for laterally urging together the second arm and the second one of the modular seat sections when in the latched position, and a plurality of third latch mechanisms for laterally urging together adjacent ones of the modular seat sections of the seating assembly when in the latched position.

In some examples, the at least one modular seat section is defined by a single modular seat section, the single modular seat section having a first side defining the first end of the seat assembly, and a second side laterally opposite the first side defining the second end of the seat assembly.

In some examples, the furniture assembly further includes a plurality of latch mechanisms each movable between unlatched and latched positions, the plurality of latch mechanisms including a plurality of first latch mechanisms for laterally urging together the first arm and the single modular seat section when in the latched position, and a plurality of second latch mechanisms for laterally urging together the second arm and the single modular seat section when in the latched position.

According to some aspects, a knock-down furniture assembly includes (a) a first arm having a first arm inboard side with at least two first female connectors attached thereto; (b) a second arm having a second arm inboard side with at least two first male connectors attached thereto; and (c) at least one seat base and a seat back for each seat base, each seat back releasably connectable to one of the at least one seat base to form at least one seat section, each seat base having laterally opposed first and second sides, the first side of each seat base having at least two first male connectors attached thereto, and the second side of each seat base having at least two first female connectors attached thereto. The first arm, the second arm, the at least one seat back, and the at least one seat base are separate components configured to be shipped to an end user unattached from one another. The at least two first female connectors of the first arm are arranged to slidably couple with the at least two first male connectors attached to the first side of any first one of the at least one seat base, and the at least two first female connectors attached to the second side of the first one of the at least one seat base are arranged to slidably couple with the at least two first male connectors of any one of the group consisting of the second arm and the first side of any other one of the at least one seat base for releasable assembly of the first arm, the at least one seat base, and the second arm.

In some examples, each of the at least one seat section further comprises at least two second male connectors attached to one of the seat base and the seat back, and at least two second female connectors attached to the other of the seat base and the seat back, the at least two second male connectors arranged to slidably couple with the at least two second female connectors to releasably attach the seat back to the seat base.

In some examples, the first female connectors each comprise a channel extending along a channel axis, and the first male connectors each comprise a slide member slidably receivable in a respective one of the channels to couple together the first male and first female connectors, and wherein the channel axis is oriented generally vertically when the furniture assembly is upright.

In some examples, the furniture assembly further includes a first plurality of latch mechanisms arranged to further secure the first arm to the first side of the first seat section, and a second plurality of latch mechanisms arranged to latch the second side of the first seat section to any one of the group consisting of the second arm and the first side of any other one of the least one seat section. In some examples, each latch mechanism includes a keeper fixed to a first furniture component and a clasp fixed to a second furniture component adjacent the first furniture component, the first and second furniture components comprising respective ones of the first arm, the at least one seat section, and the second arm, and wherein the clasp is movable relative to the keeper between unlatched and latched positions, each latch mechanism exerting a lateral clamping force urging the first and second furniture components together when the clasp is in the latched position.

According to some aspects, a kit of parts shippable to an end user in a plurality of boxes for assembly of the parts by the end user into seating furniture, the kit pf parts includes: (a) a plurality of seat bases, each seat base having a seat base first side and a seat base second side spaced laterally apart from the seat base first side, each seat base first side having at least one slide connector of a plurality of slide connectors secured thereto, each seat base second side having at least one channel connector of a plurality of channel connectors secured thereto, and each seat base having an upwardly protruding portion at a rear of the seat base defining a raised upper surface, the raised upper surface of each seat base including a plurality of rear connectors; (b) a plurality of seat backs equal in quantity to the plurality of seat bases, each of the seat backs having a top, a bottom vertically opposite the top, and a plurality of bottom connectors adjacent the bottom and alignable with the plurality of rear connectors of any one of the plurality of seat bases for removably attaching the seat backs to the seat bases; (c) a first armrest with at least another channel connector of the plurality of channel connectors secured thereto, each channel connector of the first armrest comprising a first channel for slidably receiving a first slide member of a respective slide connector of any first seat base of the plurality of seat bases for securing the first armrest and the first seat base together; and (d) a second armrest with at least another slide connector of the plurality of slide connectors secured thereto, each slide connector of the second armrest comprising a second slide member for slidable insertion into a second channel of a respective channel connector of any second seat base of the plurality of seat bases for securing the second armrest and the second seat base together. Each channel connector secured to the first seat base includes a third channel for slidably receiving a third slide member of a respective slide connector of any other seat base of the plurality of seat bases for securing together said other seat base and the first seat base.

In some examples, the plurality of seat bases consists of two seat bases, the third slide member defined by the at least one slide connector secured to the first side of the second seat base and slidably receivable in the third channel for securing together the second seat base and the first seat base.

In some examples, the plurality of seat bases includes a third seat base, the third slide member defined by the at least one slide connector secured to the first side of the third seat base and slidably receivable in the third channel for securing together the third seat base and the first seat base.

In some examples, the plurality of seat bases consists of three seat bases, and wherein each channel connector that is secured to the second side of the third seat base comprises a fourth channel, and each slide connector that is secured to the first side of the second seat base comprises a fourth slide member, the fourth slide member receivable in the fourth channel for securing together the third seat base and the second seat base.

In some examples, the channel of each channel connector is oriented generally vertically when the assembled seating furniture is upright for use.

In some examples, the seat bases are identical to one another such that each seat base can be assembled in any position between the first and second armrests to facilitate assembly.

In some examples, the kit of parts further includes a plurality of latch mechanisms each movable between unlatched and latched positions, the plurality of latch mechanisms including a plurality of first latch mechanisms for laterally urging together the first armrest and the first seat base when in the latched position, and a plurality of second latch mechanisms for laterally urging together the second armrest and the second seat base when in the latched position. In some examples, each first latch mechanism includes a keeper fixed to the first armrest and a clasp fixed to the first side of the first seat base, and wherein each second latch mechanism includes another keeper fixed to the second side of the second seat base and another clasp fixed to the second armrest, each clasp movable relative to the respective keeper of each latch mechanism between unlatched and latched positions, each latch mechanism exerting a lateral clamping force urging the respective seat section and respective armrest together when the clasp is in the latched position.

According to some aspects, a seat section of a knock-down furniture assembly includes: (a) a seat base having a front, a rear opposite the front, first and second sides spaced laterally apart and extending between the front and rear of the seat base, and an upwardly protruding portion at the rear defining a raised upper surface, the raised upper surface including a plurality of rear connectors, and the first side including at least one male seat connector and the second side including at least one female seat connector, the female seat connector of the seat base interlockable with another male seat connector of an adjacent, identical, seat base; and (b) a seat back having a top, a bottom vertically opposite the top, and a plurality of bottom connectors adjacent the bottom and alignable with the rear connectors of the seat base for removably attaching the seat back to the seat base to form the seat section.

In some examples, each of the bottom connectors comprises one of a male back connector and a female back connector, and each of the rear connectors comprises the other of said male back connector and said female back connector, each female back connector defining a back channel extending along a back channel axis and each male connector comprising a back slide member slidable into the back channel along the back channel axis for interlocking thereof.

In some examples, each female seat connector defines a seat channel extending along a seat channel axis oriented generally vertically when the seat section is in use, and each male seat connector comprises a seat slide member, the seat channel slidably receiving the seat slide member of the adjacent, identical seat base for releasable interlocking thereof.

According to some aspects, a knock-down furniture assembly includes: (a) a seating assembly having a first end and a second end laterally opposite the first end, the first end including a plurality of first end connectors and the second end including a plurality of second end connectors, the seating assembly including at least one seat section; (b) a first arm having a first outboard side and a first inboard side laterally opposite the first outboard side, the first inboard side including a plurality of first arm connectors, each first arm connector and a corresponding first end connector defining a first pair of interlockable connectors for removably attaching the first arm to the first end of the seating assembly; and (c) a second arm having a second outboard side and a second inboard side laterally opposite the second outboard side, the second inboard side including a plurality of second arm connectors, each second arm connector and a corresponding second end connector defining a second pair of interlockable connectors for removably attaching the second arm to the second end of the seating assembly. Each pair of interlockable connectors comprises (i) a female bracket defining a bracket channel extending along a channel axis oriented generally vertically when the furniture assembly is upright, and (ii) a male bracket comprising a slide member slidable into the bracket channel generally along the channel axis for interlocking thereof. The seating assembly includes at least one modular seat section, each seat section including: (i) a seat base having a front, a rear opposite the front, and an upwardly protruding portion at the rear defining a raised upper surface, the raised upper surface including having a plurality of rear connectors; and (ii) a seat back having a top, a bottom vertically opposite the top, and a plurality of bottom connectors adjacent the bottom and alignable with the rear connectors of the seat base, each bottom connector and a corresponding rear connector defining a fourth pair of interlockable connectors for removably attaching the seat back to the seat base to form the seat section.

In some examples, the bracket channel extends along the channel axis between a first channel end and a second channel end opposite the first channel end, the first channel end defining a channel opening oriented normal to the channel axis for insertion of the slide member into the bracket channel.

In some examples, the bracket channel has a channel length extending along the channel axis and a channel width tapering along the channel length at a first taper angle, and the slide member has a slide member length and a slide member width tapering along the slide member length at a second taper angle corresponding to the first taper angle for nesting of the slide member in the bracket channel.

In some examples, the male and female brackets of the first pair of interlockable connectors are identical to the male and female brackets of the second pair of interlockable connectors.

In some examples, the seating assembly includes a plurality of the modular seat sections removably attachable to each other in a sofa arrangement, each seat section having a first side and a second side laterally opposite the first side, the first side of a first one of the seat sections defining the first end of the seating assembly and the second side of a second one of the seat sections defining the second end of the seating assembly. In some examples, the seat sections are identical to each other to facilitate interchangeability therebetween.

In some examples, the first side of each seat section includes a plurality of first side connectors and the second side of each seat section includes a plurality of second side connectors, each first side connector of any seat section interlockable with a corresponding second side connector of an adjacent seat section to define a third pair of interlockable connectors for removably attaching adjacent seat sections to each other.

In some examples, the first side connectors of the first one of the seat sections define the first end connectors for attaching the first arm to the seating assembly, and the second side connectors of the second one of the seat sections define the second end connectors for attaching the second arm to the seating assembly.

In some examples, the first and second side connectors of each seat section are on the seat base and the seat back is free of any of the first and second side connectors.

In some examples, the furniture assembly further includes a plurality of latch mechanisms for securing the first arm to the seating assembly, the second arm to the seating assembly, and each seat section to an adjacent seat section.

In some examples, the seat section has a first side for defining the first end of the seating assembly, and a second side laterally opposite the first side for defining the second end of the seating assembly.

According to some aspects, a knock-down furniture assembly includes: (a) a seating assembly having a first end and a second end laterally opposite the first end, the first end including a plurality of first end connectors and the second end including a plurality of second end connectors, the seating assembly including at least one seat section, each seat section having a seat base and a seat back; (b) a first arm having a first outboard side and a first inboard side laterally opposite the first outboard side, the first inboard side including a plurality of first arm connectors, each first arm connector and a corresponding first end connector defining a first pair of interlockable connectors for removably attaching the first arm to the first end of the seating assembly; and (c) a second arm having a second outboard side and a second inboard side laterally opposite the second outboard side, the second inboard side including a plurality of second arm connectors, each second arm connector and a corresponding second end connector defining a second pair of interlockable connectors for removably attaching the second arm to the second end of the seating assembly. Each pair of interlockable connectors comprising (i) a female bracket defining a bracket channel extending along a channel axis oriented generally vertically when the furniture assembly is upright, and (ii) a male bracket comprising a slide member slidable into the bracket channel generally along the channel axis for interlocking thereof. The furniture assembly further includes: (d) a plurality of latch mechanisms for securing together adjacent ones of the first arm, the at least one seat section, and the second arm when the latch mechanisms are closed, each latch mechanism including a first member fixed to a first furniture component and a second member fixed to a second furniture component adjacent the first furniture component, the first and second furniture components comprising respective ones of the first arm, the at least one seat section, and the second arm, and wherein closing each latch mechanism pulls the first and second furniture components together along a latch axis that is generally perpendicular to the channel axis. The first arm includes two female brackets attached thereto, the second arm includes two male brackets attached thereto, and the seat base includes two female brackets attached thereto on one side and two male brackets attached thereto on an opposite side, and wherein the two male brackets attached to the seat base are arranged to slidably couple with the two female brackets attached to the first arm, and the two female brackets attached to the seat base are arranged to slidably couple with the two male brackets attached to the second arm.

In some examples, the at least one seat base includes a first seat base and at least a second seat base, and wherein the two male brackets attached to the first seat base are engageable with the two female brackets attached to the second seat base.

In some examples, the female brackets comprise a base plate and a pair of retaining flanges spaced apart from the base plate and defining the bracket channel between the retaining flanges and the base plate.

In some examples, the bracket channel extends along the channel axis between a first channel end and a second channel end opposite the first channel end, the first channel end defining a channel opening oriented normal to the channel axis for insertion of the slide member into the bracket channel.

According to some aspects, a knock-down furniture assembly includes: (a) a seating assembly extending along a seating axis between a first end and a second end laterally opposite the first end, the first end including a plurality of first end connectors and the second end including a plurality of second end connectors, the seating assembly including at least one seat section, each seat section having a seat base and a seat back; (b) a first arm having a first outboard side and a first inboard side laterally opposite the first outboard side, the first inboard side including a plurality of first arm connectors, each first arm connector and a corresponding first end connector defining a first pair of interlockable connectors for removably attaching the first arm to the first end of the seating assembly; and (c) a second arm having a second outboard side and a second inboard side laterally opposite the second outboard side, the second inboard side including a plurality of second arm connectors, each second arm connector and a corresponding second end connector defining a second pair of interlockable connectors for removably attaching the second arm to the second end of the seating assembly. Each pair of interlockable connectors comprises (i) a female bracket comprising a base plate and a pair of retaining flanges spaced apart from the base plate and defining a bracket channel between the retaining flanges and the base plate, the bracket channel extending along a channel axis oriented generally perpendicular to the seating axis, and (ii) a male bracket comprising a slide member slidable into the bracket channel generally along the channel axis for interlocking thereof. The first arm includes two female brackets attached thereto, the second arm includes two male brackets attached thereto, and the seat base includes two female brackets attached thereto on one side and two male brackets attached thereto on an opposite side, and wherein the two male brackets attached to the seat base are arranged to slidably couple with the two female brackets attached to the first arm, and the two female brackets attached to the seat base are arranged to slidably couple with the two male brackets attached to the second arm.

In some examples, the bracket channel has a channel length extending along the channel axis and a channel width tapering along the channel length.

BRIEF DESCRIPTION OF THE DRAWINGS

The drawings included herewith are for illustrating various examples of apparatuses, assemblies, and methods of the present specification and are not intended to limit the scope of what is taught in any way. In the drawings:

FIG. 27 is a side view of an example female bracket for the furniture assembly of FIG. 15;

FIG. 28 is a side view of an example male bracket for the furniture assembly of FIG. 15;

FIG. 29 is a side view showing the male bracket of FIG. 28 coupled to the female bracket of FIG. 27;

FIG. 30 is a top view of the male bracket of FIG. 28 coupled to the female bracket of FIG. 27;

DETAILED DESCRIPTION

Figure 1:
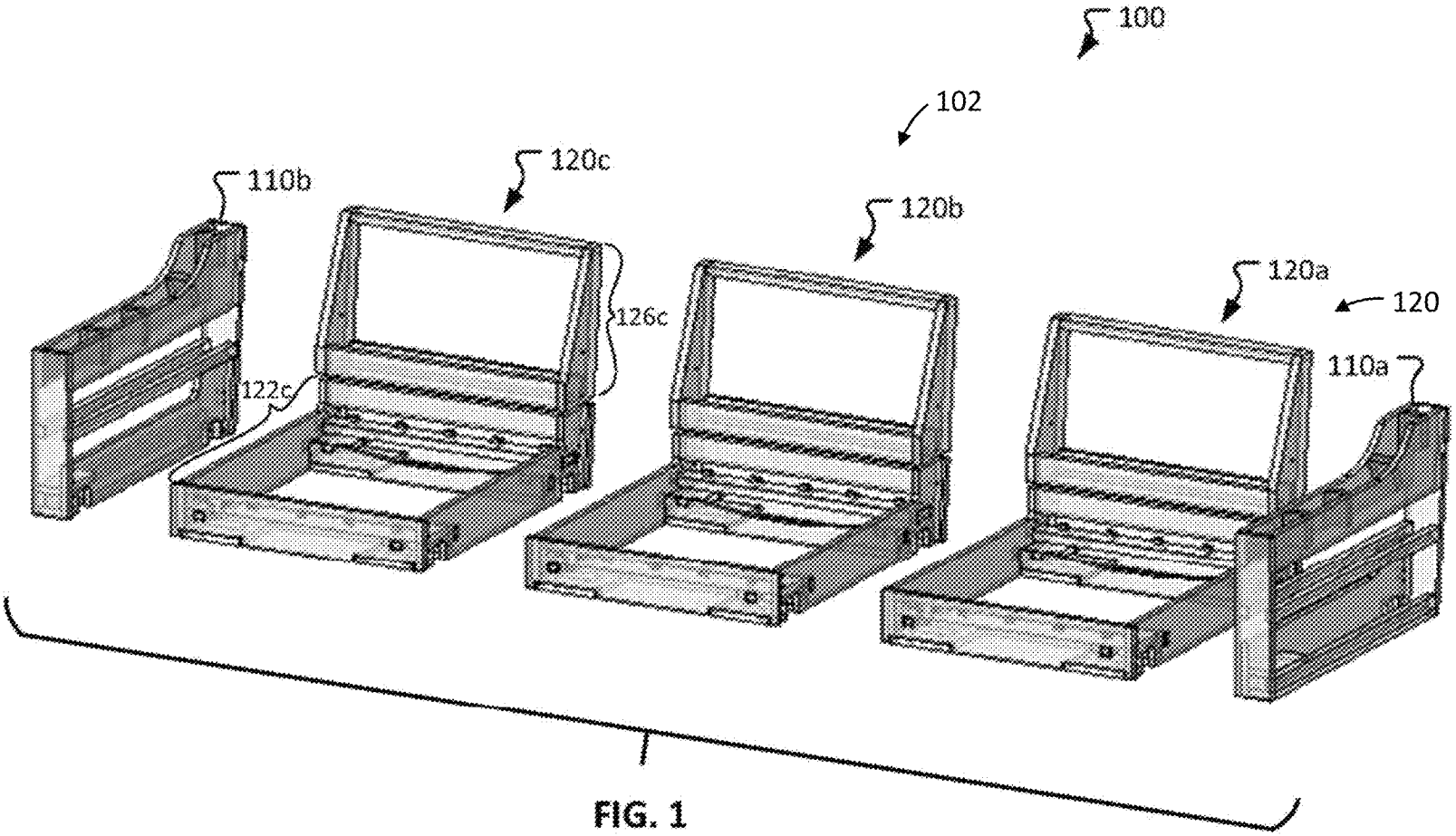
FIG. 1 is an exploded perspective view of framing for an example furniture assembly.

Various apparatuses, assemblies, or processes will be described below to provide an example of an embodiment of each claimed invention. No embodiment described below limits any claimed invention and any claimed invention may cover apparatuses, assemblies, or processes that differ from those described below. The claimed inventions are not limited to apparatuses, assemblies, or processes having all of the features of any one apparatus, assembly, or process described below or to features common to multiple or all of the apparatuses, assemblies, or processes described below. It is possible that an apparatus, assembly, or process described below is not an embodiment of any claimed invention. Any invention disclosed in an apparatus, assembly, or process described below that is not claimed in this document may be the subject matter of another protective instrument, for example, a continuing patent application, and the applicants, inventors, or owners do not intend to abandon, disclaim, or dedicate to the public any such invention by its disclosure in this document. Like reference numbers represent corresponding parts throughout.

The present disclosure relates to knock-down furniture in the form of, for example, upholstered seating furniture such as chairs and sofas. The knock-down furniture of the present disclosure can be shipped from a factory in flat boxes and then handled and assembled by an end user without tools. This can simplify shipping and delivery of the furniture and help reduce costs relative to traditional furniture that leaves the factory fully assembled. This can also allow for the furniture components to be more easily handled by the end user—for example, carried up/down narrow staircases, through narrow hallways and doorways, and around tight turns—which can reduce the need for furniture mover laborers and allow for the furniture to be utilized in areas of a home that may pose difficulty for delivery of traditional preassembled furniture.

The furniture disclosed herein can be designed for ease of assembly for the average end user. For example, in some examples, no tools (e.g. hand or power tools) are required for the assembly process. Integrated connectors such as, for example, quick assembly brackets can be used to create strong, sturdy, and accurate connections between the different furniture components. In some examples, the brackets can include pairs of male and female brackets slidable generally vertically relative to each other for interlocking the furniture components. In some examples, the brackets are tapered to provide dimensionally close and sturdy connections between the furniture components. The furniture described herein can also be readily disassembled, which can make moving out the furniture easier relative to fully assembled traditional furniture.

According to some aspects, the knock-down furniture of the present disclosure is formed of a plurality of modular components (e.g., two arms and seat components for assembling one to three or more seat sections each having a seat base and back). Some of the modular components can, for example, be used interchangeably in a variety of configurations such as in chairs, loveseats, and/or sofas of various sizes. In some examples, the modular components are built separately and packaged in individual boxes that can be shipped directly to the home or office of the end user. The modular components can be unpacked by the consumer and assembled together straight out of the boxes with relative ease. In some examples, the modular components disclosed herein are releasably attachable to each other by corresponding pairs of the quick connectors (e.g. such as slidably couplable male and female brackets).

In some examples, after modular components are connected through the quick connectors, some of the modular components (e.g. the arms and seat sections) can be latched together by latch mechanisms (e.g. draw latches with metal clasps) for pulling together and securing the components. Leg assemblies can also be installed at attachment joints in the corners and between connection interfaces of adjacent modular components for added strength and durability. Each leg assembly can help support the connection of two of the modular components, which can help provide more even weight distribution.

In some examples, the frames of the modular components can be constructed with furniture grade plywood and hardwood and mortise and tenon joints. In some embodiments, the frame joints can be glued for added durability.

Referring to FIG. 1, in the example illustrated, an example furniture assembly 100 is shown. In the example illustrated, the assembly 100 includes multiple modular furniture components. The furniture components can be assembled by an end user as described further herein. FIG. 1 shows the furniture components of the furniture assembly 100 without upholstery, cushions, fill, springs, and the like so that the framing is visible.

The furniture assembly 100 includes a first arm 110*a*, a second arm 110*b*, and a seating assembly 102 having laterally opposite ends to which the first and second arms 110*a*, 110*b* are attachable. In the example illustrated, the seating assembly 102 includes a plurality of seat sections 120 including a first seat section 120*a*, a second seat section 120*b*, and a third seat section 120*c*. While the seating assembly 102 in FIG. 1 is shown to include three seat sections 120*a*, 120*b*, 120*c*, in some examples, a single seat section, two seat sections, or more than three seat sections can be included. For example, when two seat sections are included, the assembled furniture assembly can be considered a love seat. When a single seat section is included, the assembled seating furniture assembly can be considered a chair. While the depicted seat sections 120*a*, 120*b*, 120*c* are shown as being the same size and generally identical, in some examples one or more of the seat sections for the furniture assembly can be different from (e.g. larger than) the other seat sections. In the example illustrated, each seat section 120 is made of two separate modular components, referred to herein as a seat bottom (or seat base) and a seat back. For example, the third seat section 120*c* comprises a seat bottom 122*c* and a seat back 126*c* attachable to the seat bottom 122*c*. In some examples, the seat bottoms 122 and seat backs 126 are shipped to the consumer as separate components and the consumer assembles the seat bottoms 122 and the seat backs 124 together to form the seat sections 120.

In the example illustrated, each modular component of the furniture assembly 100 is releasably attachable to one or more other modular components of the furniture assembly 100 using sturdy connectors, as described further below. The end user can assemble the modular components using such connectors and without necessarily requiring tools.

Figure 3:
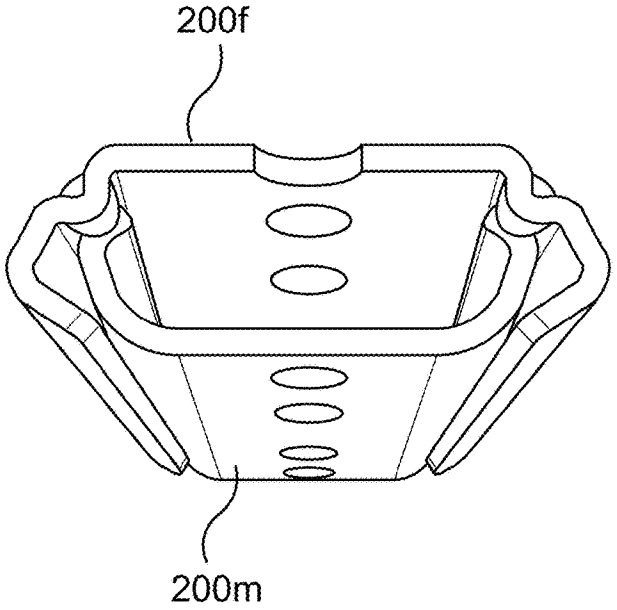
FIG. 3 is a top view of the pair of connectors of FIG. 2, shown coupled.
Figure 2:
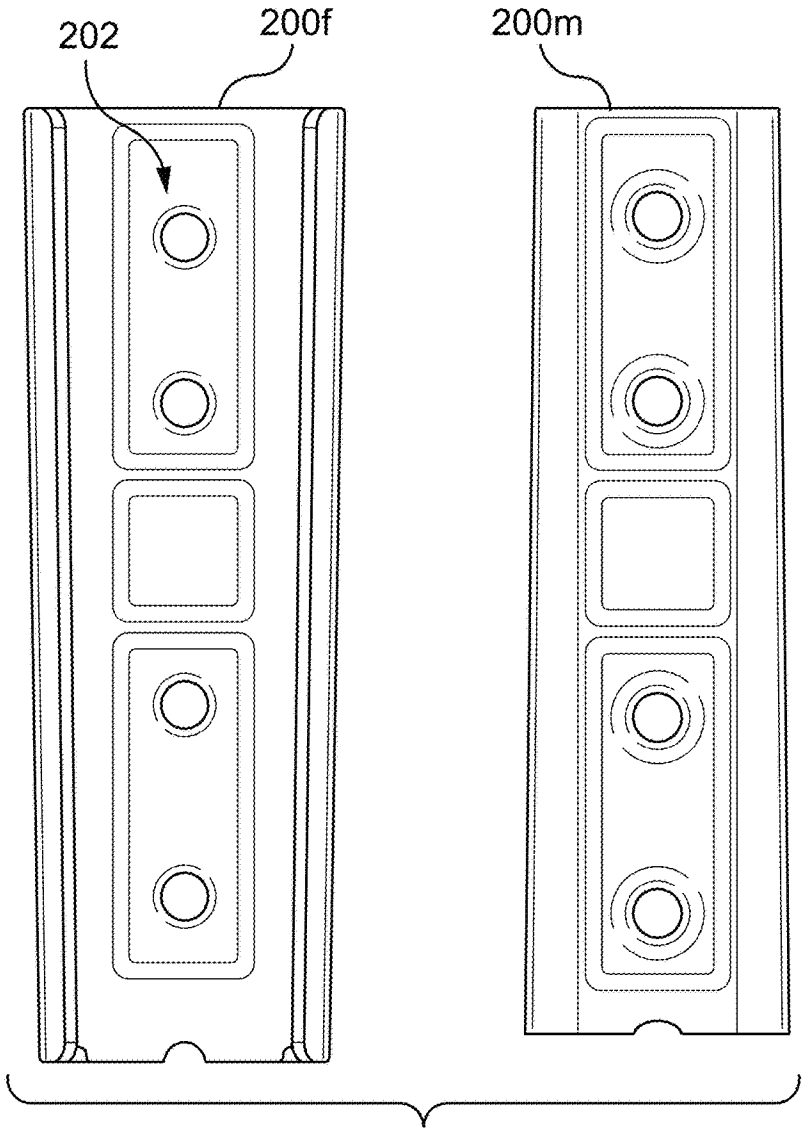
FIG. 2 is a side view of an example pair of connectors for the furniture assembly of FIG. 1, shown uncoupled.

In some examples, each of the arms 110*a*, 110*b* of the furniture assembly 100 can be attached to a respective adjacent seat section 120 using corresponding pairs of interlockable connectors. Referring to FIGS. 2 and 3, in the example illustrated, each pair of the connectors for attaching the arms to corresponding seat sections includes a first female bracket 200*f* and a first male bracket 200*m* slidably couplable to the female bracket 200*f*. As shown in FIG. 3, the male bracket 200*m* can be slid generally vertically into a slot 202 (also referred to as bracket channel 202) defined by the female bracket 200*f* for interlocking of the brackets 200*f*, 200*m*. In the example illustrated, the female bracket 200*f* and the male bracket 200*m* are tapered, with the width of each bracket 200*f*, 200*m* gradually decreasing along its length. This facilitates a joint that is secure and sturdy and provides a tight, strong fit when the tapered female bracket 200*f* and the tapered male bracket 200*m* are fully engaged with each other. In some examples, the tapered male bracket 200*m* snaps into a final position within the tapered female bracket 200*f* to become releasably detained therein.

In some examples, the female brackets 200*f* and the male brackets 200*m* are mounted to the modular components of the furniture assembly in a predetermined arrangement to allow for the modular components to be assembled in multiple different configurations (e.g., as a chair, a loveseat, or larger sofas of various sizes). For example, in some examples, the first arm 110*a* includes at least two of the tapered female brackets 200*f* fixedly attached thereto. In such examples, a first side (e.g. the right side in the example of FIG. 1) of each of the seat sections 120 can include at least two corresponding tapered male brackets 200*m* fixedly attached thereto, and any one of the seat sections 120 can be releasably attached to the first arm 110*a* by slidably inserting the tapered male brackets 200*m* of the seat section 120 into engagement within the tapered female brackets 200*f* of the first arm 110*a*. In such examples, the second arm 110*b* can include at least two of the tapered male brackets 200*m* fixedly attached thereto, and the second side (e.g. the left side in the example of FIG. 1) of each of the seat sections 120 can include two corresponding tapered female brackets 200*f* fixedly attached thereto, and any one of the seat sections 120 can be releasably attached to the second arm 110*b* by slidably inserting the tapered male brackets 200*m* of the second arm 110*b* into engagement within the tapered female brackets 200*f* of the seat section. In a similar manner, each pair of adjacent seat sections are releasably attachable to each other through interlocking of the tapered male brackets 200*m* (on the first side) of one of the seat sections 120 with corresponding tapered female brackets 200*f* (on the second side) of an adjacent seat section 120.

Figures 4, 5:
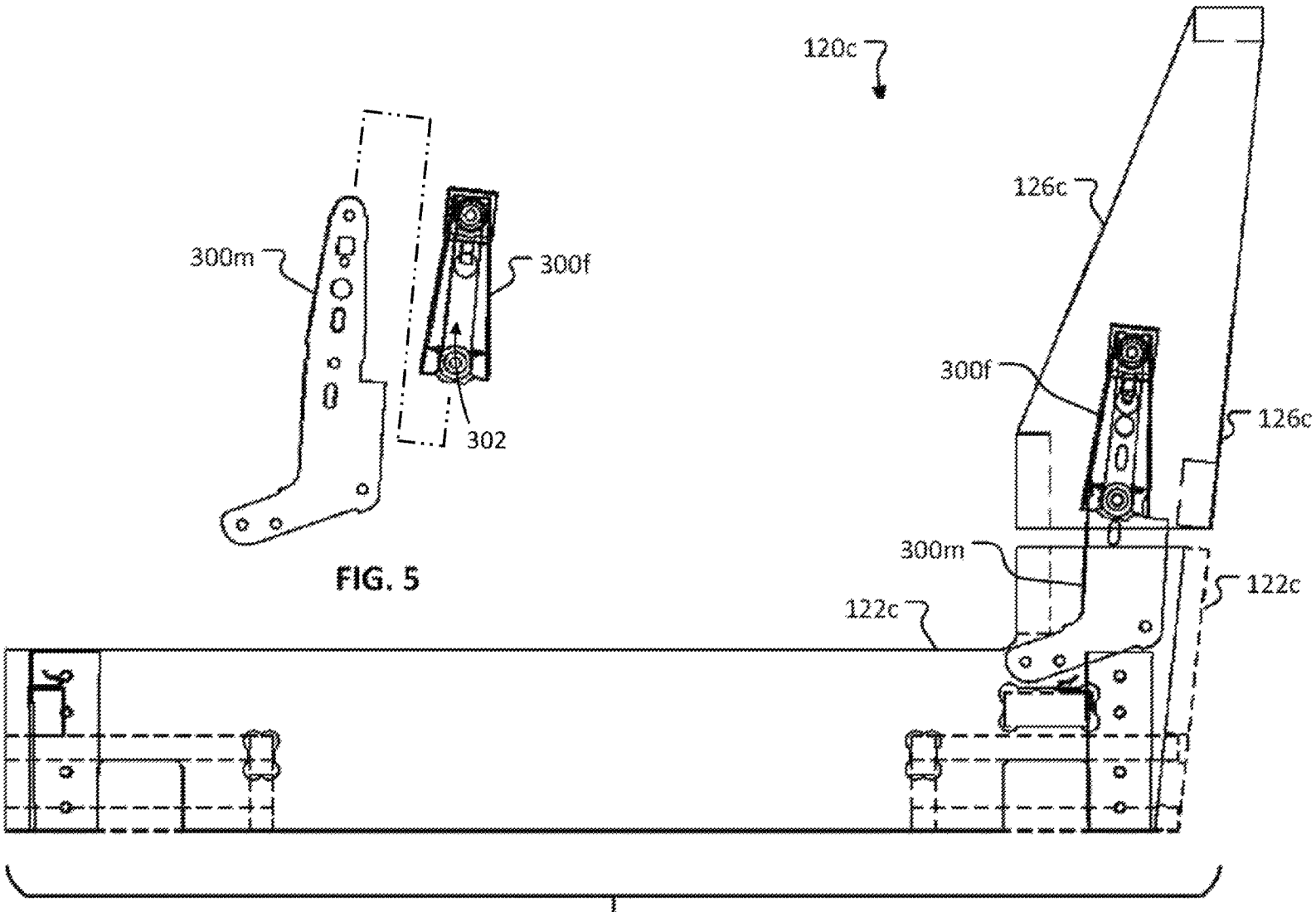
FIG. 4 is a side schematic view of an example seat section for the furniture assembly of FIG. 1.
FIG. 5 is an exploded view of an example pair of connectors for releasably attaching together the seat back and the seat base of the seat section of FIG. 4.

Referring to FIGS. 4 and 5, in the example illustrated, the seat backs 122 and the seat bottoms 126 of the seat sections 120 can be releasably attached to each other using corresponding pairs of interlockable connectors. In the example illustrated, each pair of the connectors for attaching the seat backs 122 to the bottoms 126 includes a second female bracket 300*f* and a second male bracket 300*m* slidably couplable to the female bracket 300*f*. As shown in FIG. 4, the tapered male bracket 300*m* can be slid into a slot 302 (FIG. 5, also referred to as bracket channel 302) defined by the tapered female bracket 300*f* for interlocking of the brackets 300*f*, 300*m*.

In the example illustrated, each of the female bracket 300*f* and the male bracket 300*m* are tapered, with the width of each bracket 300*f*, 300*m* gradually decreasing along its length. This facilitates a joint that is secure and sturdy and provides a tight, strong fit when the tapered female bracket 300*f* and the tapered male bracket 300*m* are fully engaged with each other. For example, in the example illustrated in FIG. 4, the seat bottom 122*c* includes at least one tapered male bracket 300*m* extending upwardly therefrom (two tapered male brackets 300*m* in the example illustrated, one adjacent each side of the seat bottom 122*c*), and the seat back 126*c* includes at least one tapered female bracket 300*f* attached thereto (two tapered female brackets 300*f* in the example illustrated, one adjacent each side of the seat back 126*c*). The seat bottom 122*c* and the seat back 126*c* can be releasably coupled together by slidably inserting the two tapered male brackets 300*m* of the seat back into engagement within the two tapered female brackets 300*f* of the seat bottom. In some examples, the tapered male bracket 300*m* snaps into a final position within the tapered female bracket 300*f* to become releasably detained therein.

Figure 8:
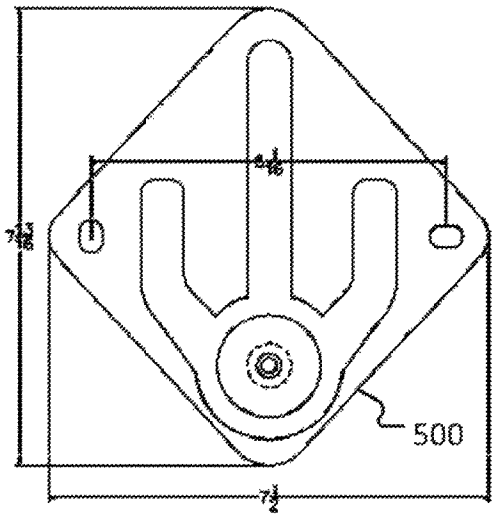
FIG. 8 is a top view of another example leg plate for the furniture assembly of FIG. 1.
Figure 6:
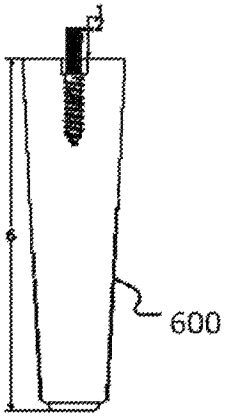
FIG. 6 is a side cutaway view of an example leg for the furniture assembly of FIG. 1.
Figure 7:
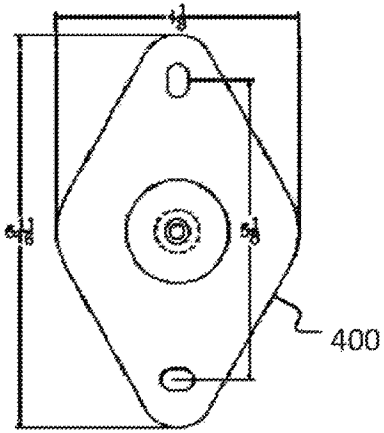
FIG. 7 is a top view of an example leg plate for the furniture assembly of FIG. 1.

Referring also to FIGS. 6 to 8, the furniture assembly 100 can include legs that are attachable to the components of the furniture assembly 100 using leg brackets. Such attachment of the legs can be performed by the end user. For example, the brackets used to attach the legs to the components of the furniture assembly 100 can include one or more leg plates (e.g. leg plates 400, 500) mountable to an underside of the furniture components for attaching the legs (e.g. leg 600) thereto. Each leg can be attachable to a corresponding leg plate through a threaded connection. The threaded connection can be between a leg screw projecting from a top end of each leg and a threaded opening in each plate for threadingly receiving the leg screw. In some embodiments, each leg plate is configured to releasably attach to two adjacent components of the furniture assembly 100 (e.g. to an arm and an adjacent seat section, or to a pair of adjacent seat sections), so that each leg supports two components.

The leg plates can include one or more center leg plates 400 (FIG. 7) and/or one or more end leg plates 500 (FIG. 8). The legs, such as the example leg 600, can be threadedly coupled to (and therefore removable from) the leg plates 400, 500. In the example illustrated, the center leg plates 400 are releasably attachable to an underside of the furniture components at the junction/interface between a pair of two adjacent seat sections (e.g., at the junction/interface between the seat sections 120*a* and 120*b*, and between the seat sections 120*b* and 120*c*). A mounting hole on one end of the center leg plate 400 can be used to attach the center leg plate 400 to one seat section 120, and another mounting hole on the opposite end of the center leg plate 400 can be used to attach the center leg plate 400 to the adjacent seat section 120. The leg 600 is then coupled to the center leg plate 400 and can support both adjacent seat sections. In some examples, each seat section includes threaded inserts attached to its frame for threadingly receiving a leg plate screw (e.g., a thumbscrew that does not require tooling to install) for attaching the center leg plate 400 to the pair of adjacent seat sections.

In some examples, the end leg plate 500 can be similarly used to attach an arm to an adjacent seat section, and to allow for a corresponding leg 600 to be releasably attached thereto. For example, for the furniture assembly 100 of FIG. 1, the end leg plates 500 can be installed at the junction/ interface between the first arm 110*a* and the first seat section 120*a*, and between the second arm 110*b* and the third seat section 120*c*. One or more of the leg plates can be used at each of the junctions/interfaces. For example, in some examples two of the end leg plates 500 are used at each of the junctions/interfaces (one adjacent a front of the furniture assembly 100 and one adjacent a rear of the furniture assembly 100).

Figure 9:
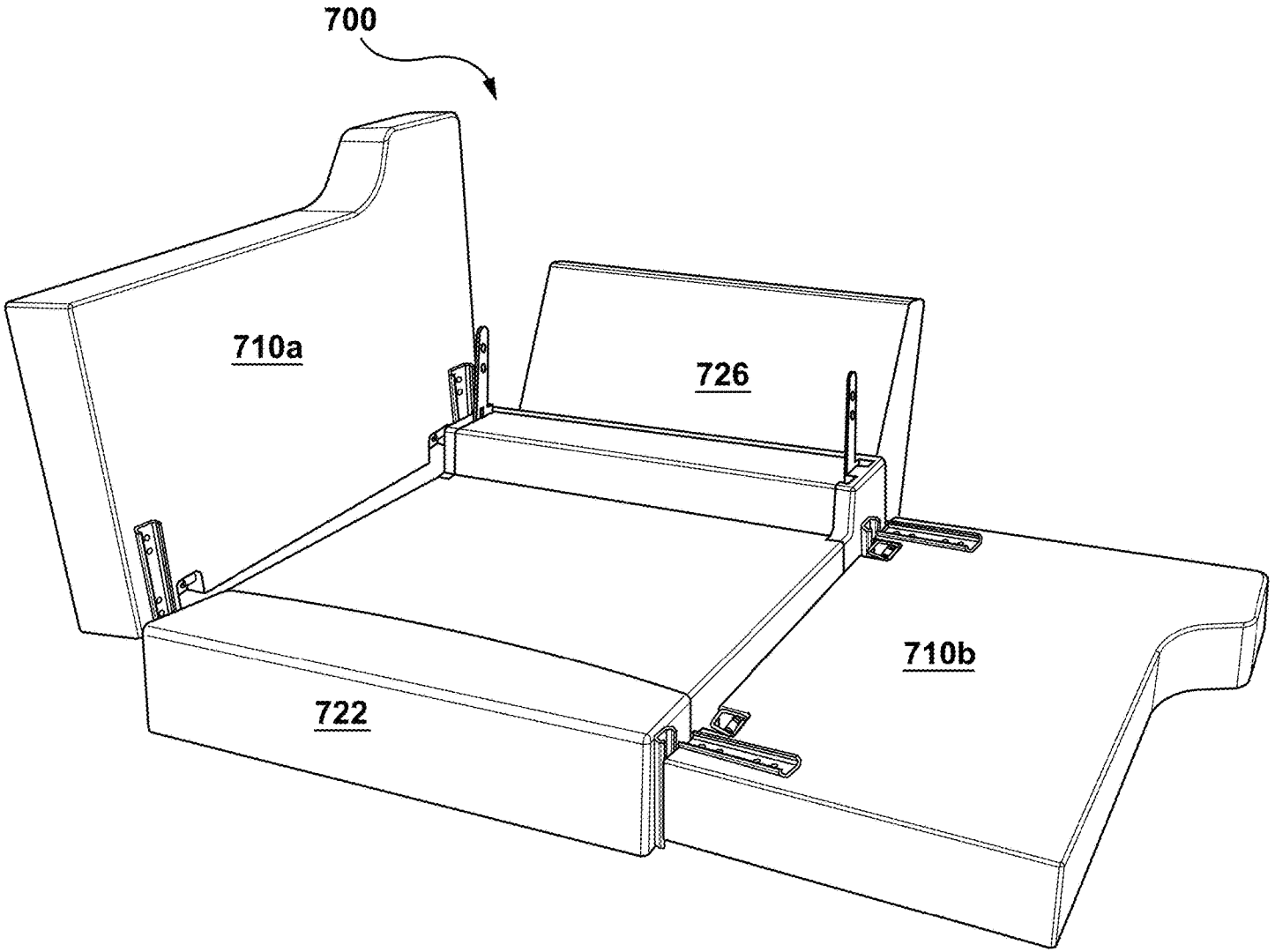
FIG. 9 shows a step of an assembly process for another example furniture assembly, the step including attaching a first arm portion to a seat base portion.
Figure 10:
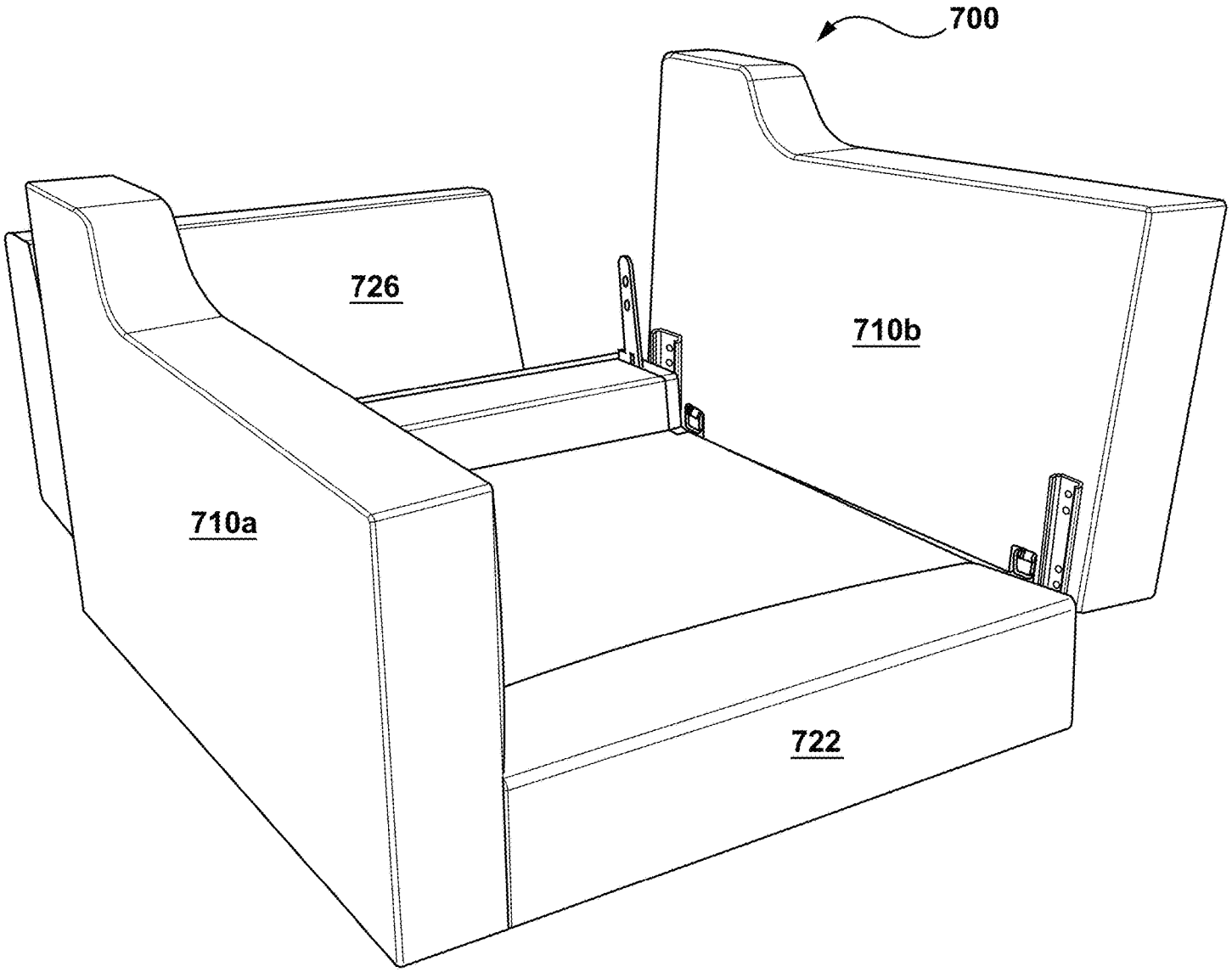
FIG. 10 shows another step of the assembly process that includes attaching a second arm portion to the seat base portion.

Referring to FIGS. 9 to 14, an example process for assembling another example furniture assembly 700 (in the form of a chair 700) is shown. The chair 700 includes a first arm 710*a*, a second arm 710*b*, a seat bottom 722, and a seat back 726. In FIG. 9, the assembler is slidably attaching the first arm 710*a* to the seat bottom 722, by sliding a pair of male brackets generally vertically (relative to the top of the furniture assembly 700) into a corresponding pair of female brackets for interlocking thereof. In the example step shown in FIG. 10, the assembler is slidably attaching the second arm 710*b* to the seat bottom 722 in a similar manner. Tapered male/female brackets (such as those disclosed herein, including at FIGS. 2-3) are used in the present example to create a tight, strong fit between the first arm 710*a* and the seat bottom 722, and between the second arm 710*b* and the seat bottom 722.

Figure 11:
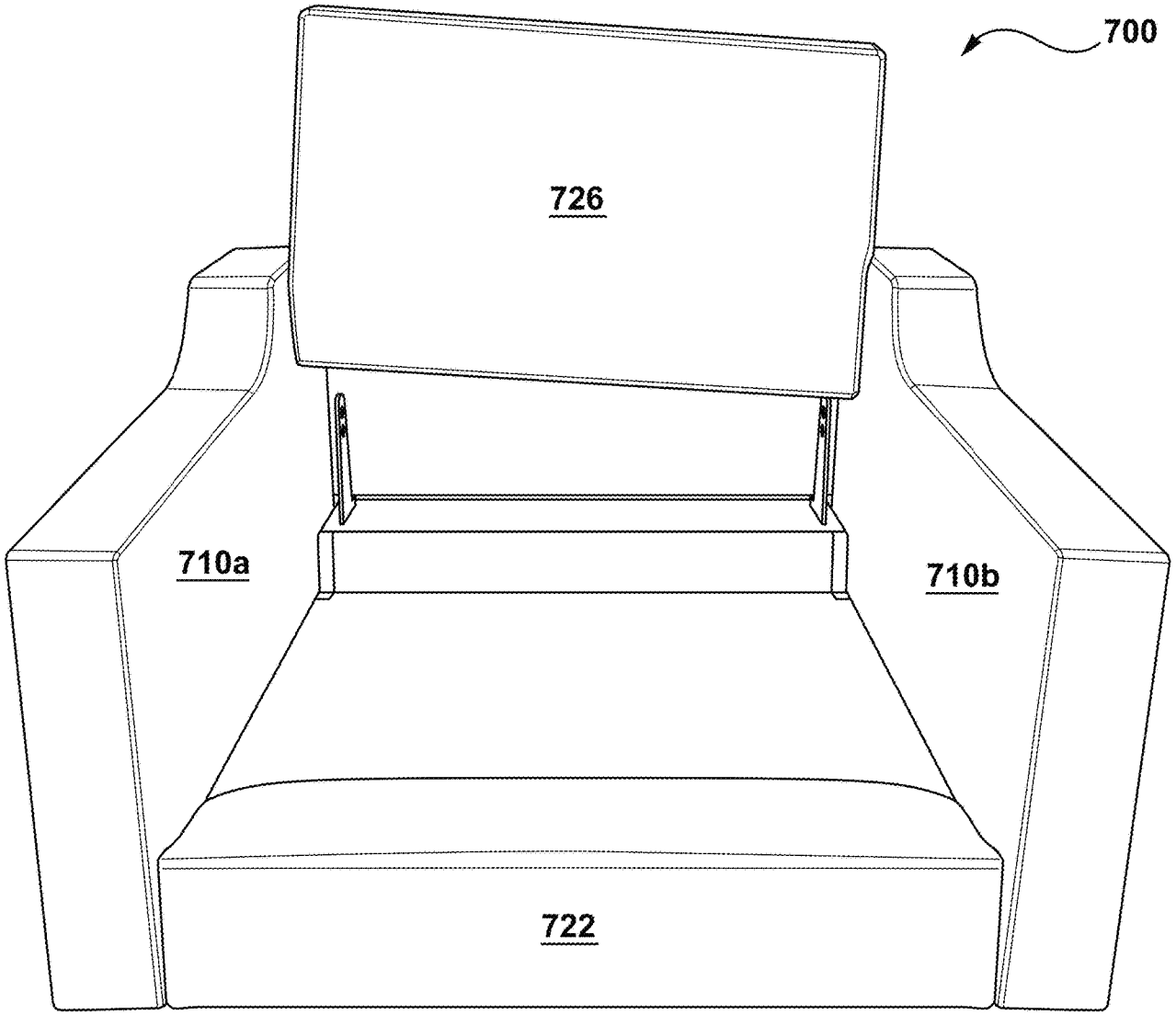
FIG. 11 shows another step of the assembly process that includes attaching a seat back portion to the seat base portion.

In the example shown in FIG. 11, the assembler is slidably attaching the seat back 726 to the seat bottom 722, by sliding a pair of male brackets generally vertically (relative to the top of the furniture assembly 700) into a corresponding pair of female brackets for interlocking thereof. In some embodiments, tapered male/female brackets (such as those disclosed herein, including at FIGS. 4-5) are used to create a tight, strong fit between the seat back 726 to the seat bottom 722.

Figure 12:
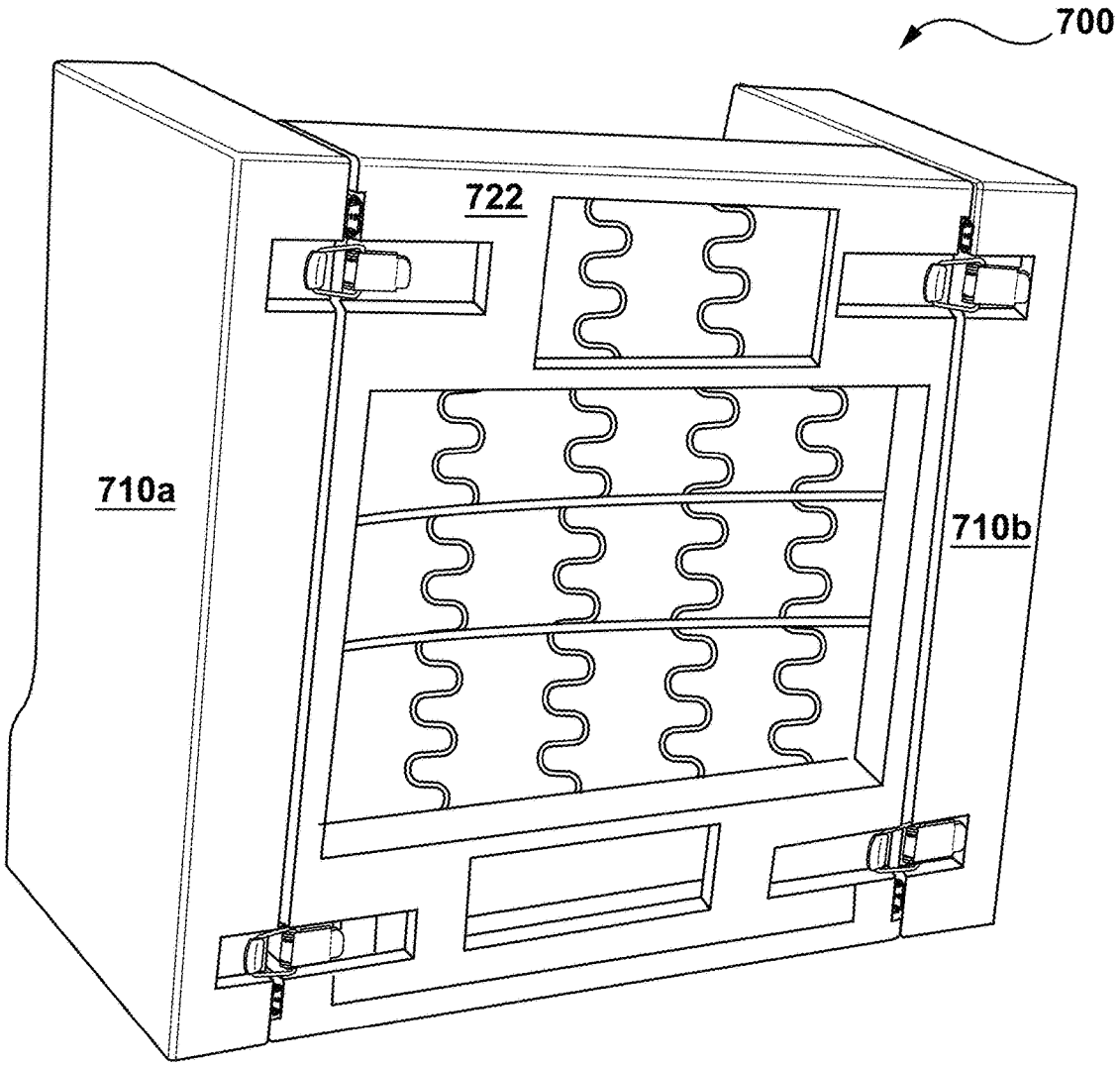
FIG. 12 shows another step of the assembly process that includes latching the first arm portion to the seat base portion.

In the example shown in FIG. 12, the assembler is latching the seat bottom 722 and the first arm 710*a* together. In some examples, an over center latch mechanism (e.g. in the form of a draw latch) is used for this purpose. Using such a latch mechanism, the seat bottom 722 and the first arm 710*a* can be pulled together to exert a compressive force between the seat bottom 722 and the first arm 710*a* to help further secure the components and increase rigidity of the furniture assembly 700. In the example shown, two latch mechanisms are provided between the seat bottom 722 and the first arm 710*a* (one adjacent a front of the chair 700 that the assembler is shown latching, and one adjacent a rear of the chair 700, shown at the bottom of FIG. 12). A pair of similar latch mechanisms are provided on the opposite side of the seat bottom 722 for latching the second arm 710*b* to the seat bottom 722 in a similar manner. In other examples in which the furniture assembly includes multiple seat sections (such as the example shown in FIG. 1), similar latch mechanisms can be provided between adjacent seat sections for latching the adjacent seat sections to each other in a similar manner.

Figure 13:
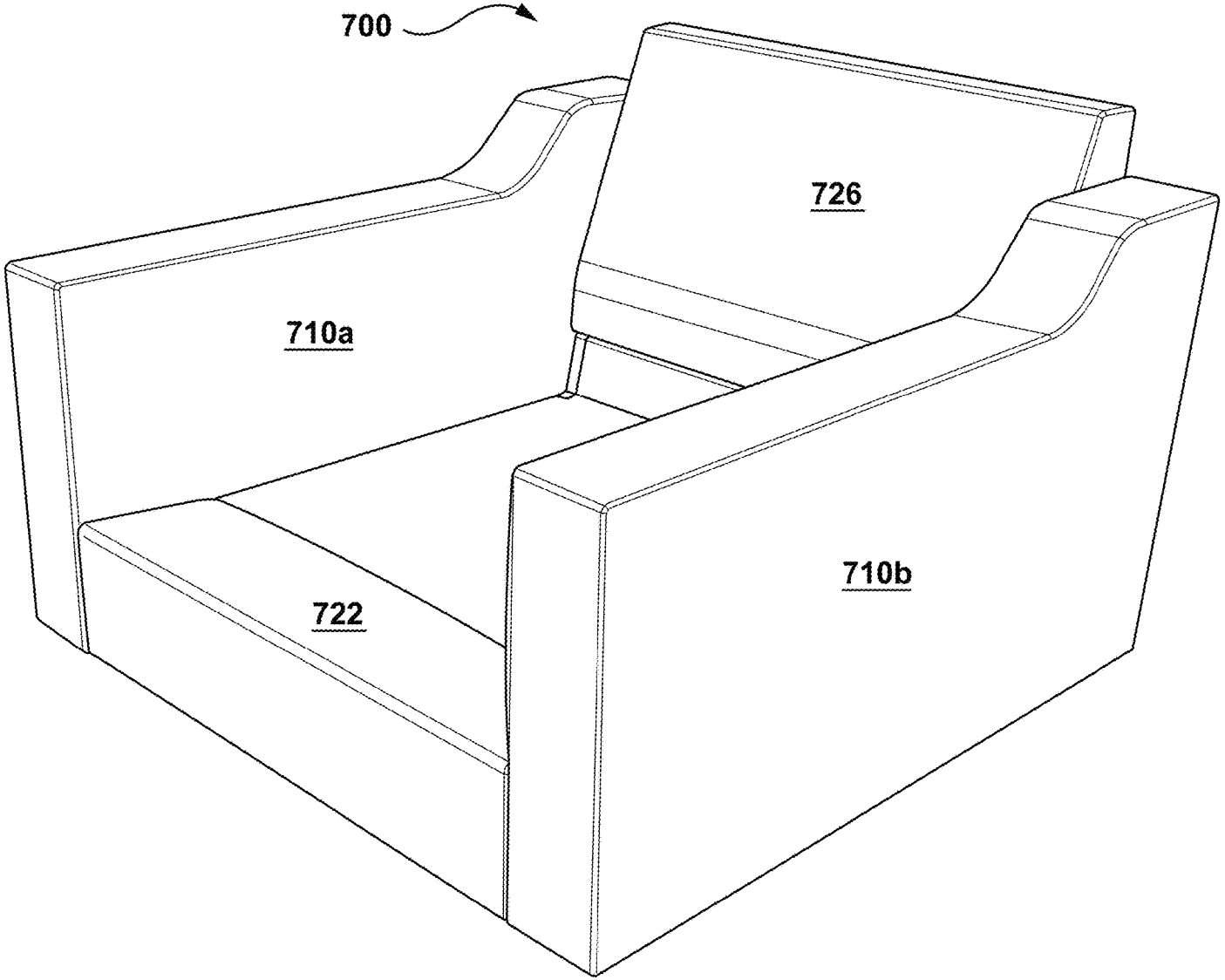
FIG. 13 shows the furniture assembly of FIG. 9 without seat and back cushions.
Figure 14:
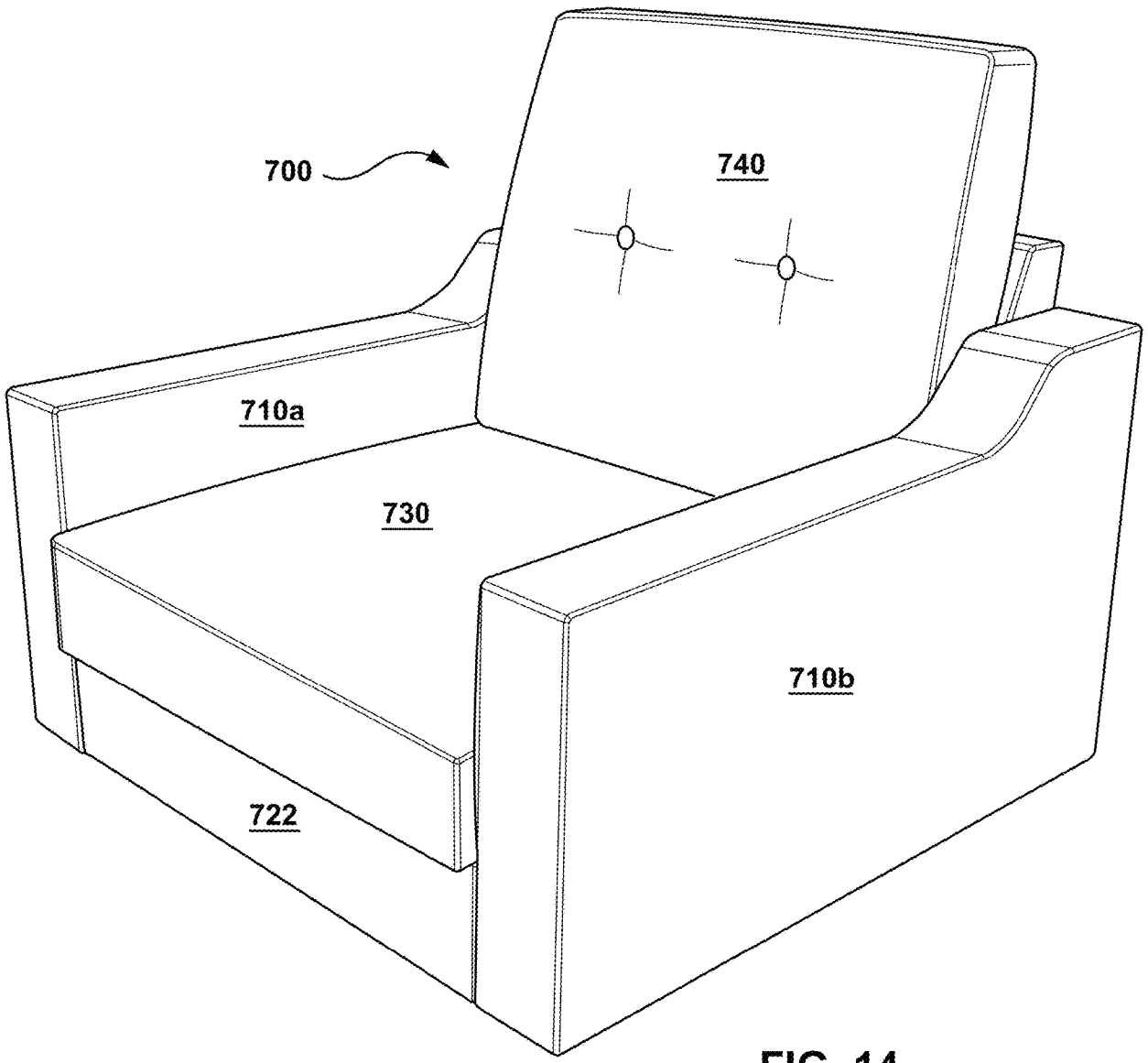
FIG. 14 shows the furniture assembly of FIG. 9 with seat and back cushions.

FIG. 13 shows an example of the chair 700 generally assembled but without cushions. In the example shown, the first arm 710*a* and the second arm 710*b* are releasably attached to the seat bottom 722, and the seat back 726 is releasably attached to the seat bottom 722. In some examples, leg mounting plates and legs can be attached to the underside of the components (e.g., as disclosed herein, including with reference to FIGS. 6 to 8). As shown in FIG. 14, in this example, a seat bottom cushion 730 and a seat back cushion 740 are added to complete the chair 700.

Figure 15:
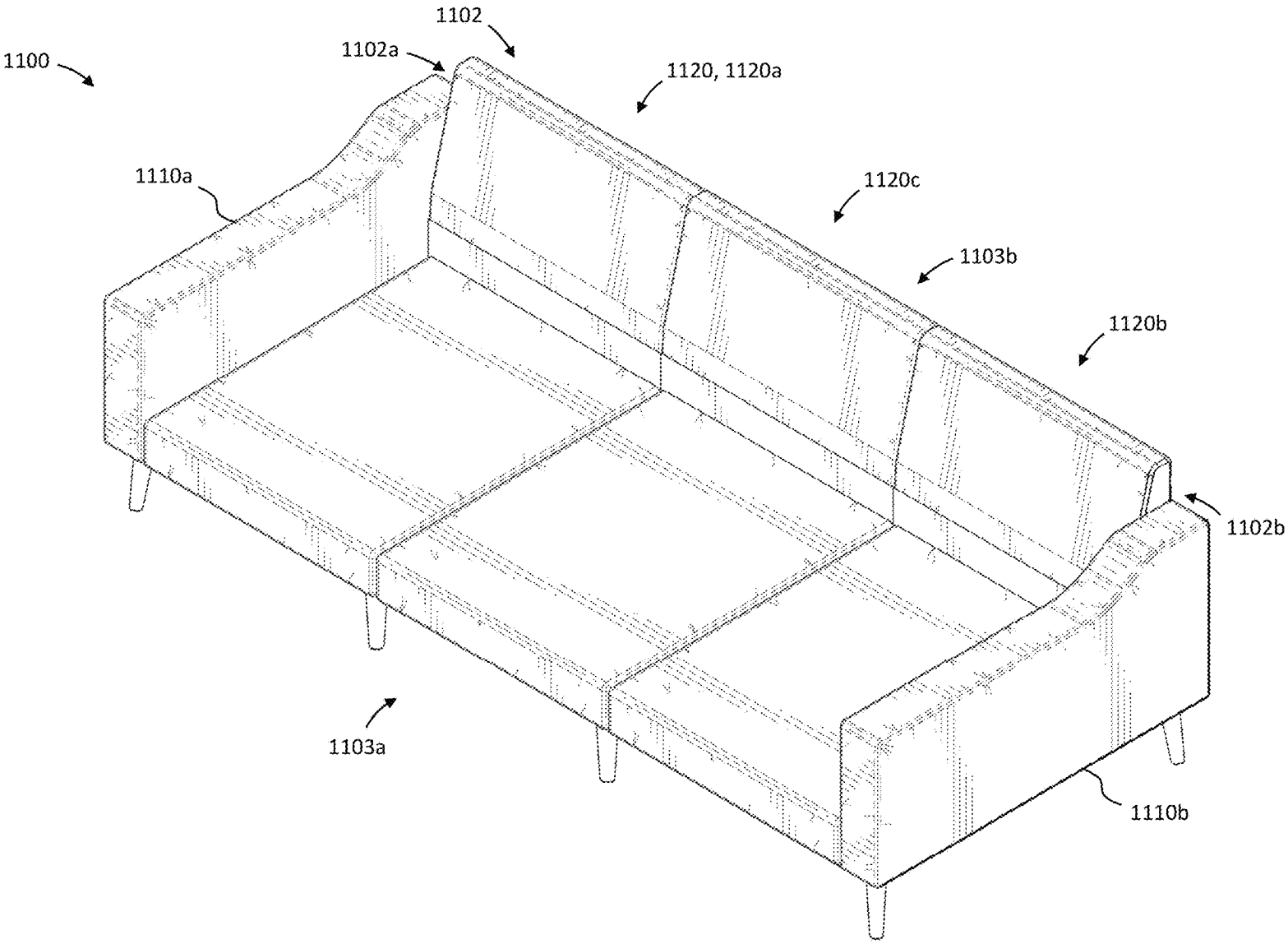
FIG. 15 is a perspective view of another example furniture assembly.

Referring to FIG. 15, another example knock-down furniture assembly 1100 is shown. The furniture assembly 1100 has similarities to the furniture assembly 100, and like features are identified with like reference characters, incremented by 1000.

In the example illustrated, the furniture assembly 1100 includes a seating assembly 1102 having an assembly first end 1102*a* and an assembly second end 1102*b* laterally opposite the first end 1102*a*. A first arm 1110*a* is removably attached to the first end 1102*a* of the seating assembly 1102, and a second arm 1110*b* is removably attached to the second end 1102*b* of the seating assembly 1102.

Figure 16:
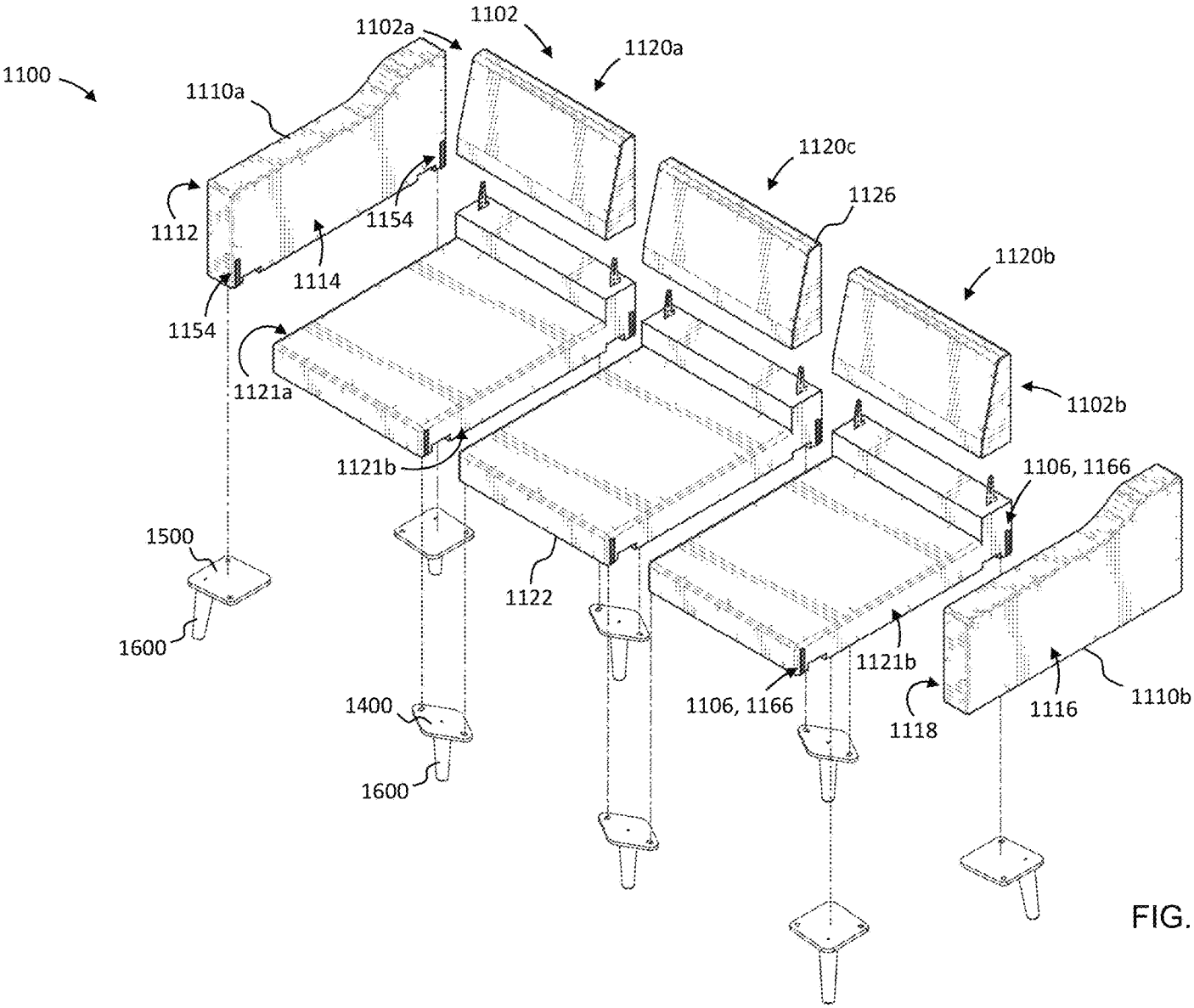
FIG. 16 is an exploded perspective view of the furniture assembly of FIG. 15.
Figure 17:
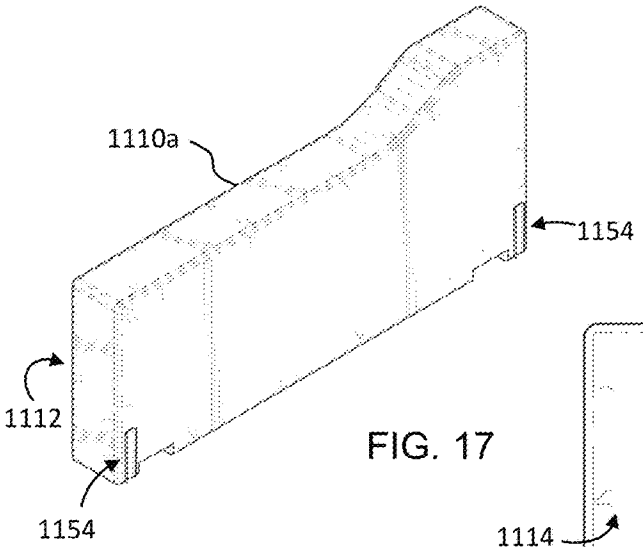
FIG. 17 is a perspective view of an arm portion of the furniture assembly of FIG. 15.
Figure 18:
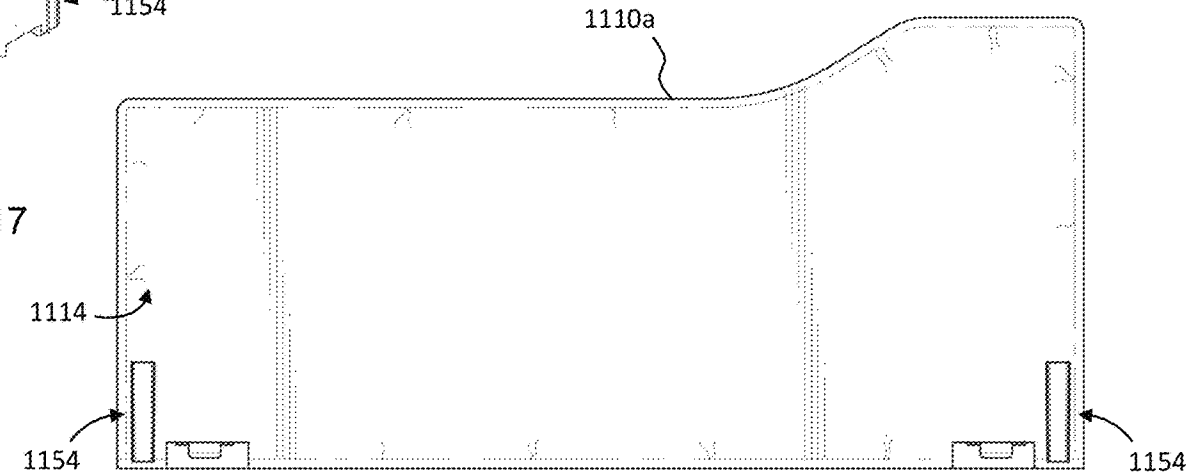
FIG. 18 is an inboard side view of the arm portion of FIG. 17.
Figure 19:
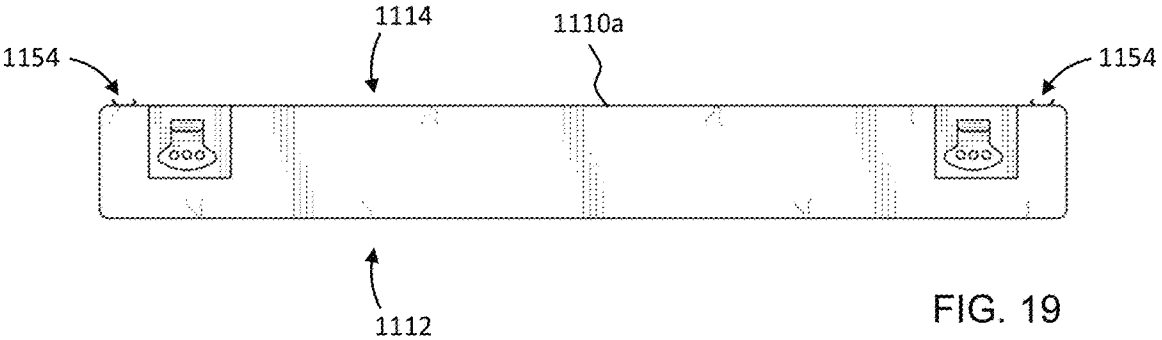
FIG. 19 is a bottom view of the arm portion of FIG. 17.

Referring to FIG. 16, in the example illustrated, the first end 1102*a* of the seating assembly 1102 includes a plurality of first end connectors 1104 (FIG. 25) and the second end 1102*b* of the seating assembly 1102 includes a plurality of second end connectors 1106.

In the example illustrated, the first arm 1110*a* has a first outboard side 1112 directed away from the seating assembly 1102, and a first inboard side 1114 laterally opposite the first outboard side 1112 and directed toward the seating assembly 1102. In the example illustrated, the first inboard side 1114 includes a plurality of first arm connectors 1154. Each first arm connector 1154 and a corresponding first end connector 1104 (FIG. 25) define a first pair of interlockable connectors for removably attaching the first arm 1110*a* to the first end 1102*a* of the seating assembly 1102. In the example illustrated, the first inboard side 1114 of the first arm 1110*a* includes two of the first arm connectors 1154 and the first end 1102*a* of the seating assembly 1102 includes two corresponding first end connectors 1104 (FIG. 25), defining two first pairs of interlockable connectors for removably attaching the first arm 1110*a* to the first end 1102*a*. One first pair of the interlockable connectors is adjacent a front 1103*a* (FIG. 15) of the seating assembly 1102 and the other first pair of interlockable connectors is adjacent a rear 1103*b* (FIG. 15) of the seating assembly 1102.

Figure 20:
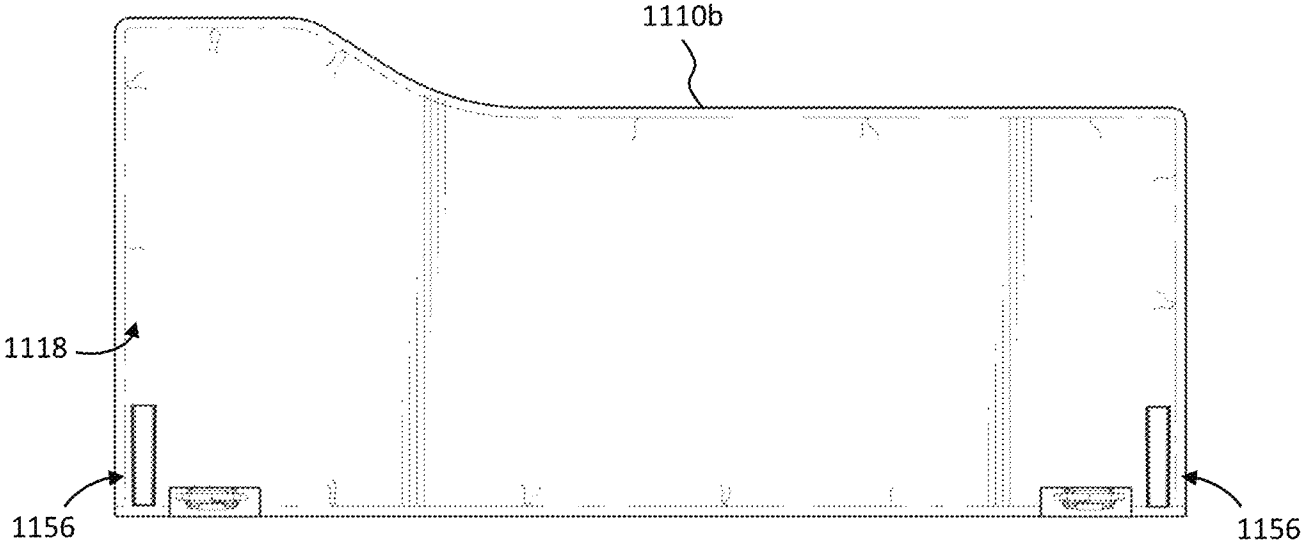
FIG. 20 is an inboard side view of another arm portion of the furniture assembly of FIG. 15.
Figure 21:
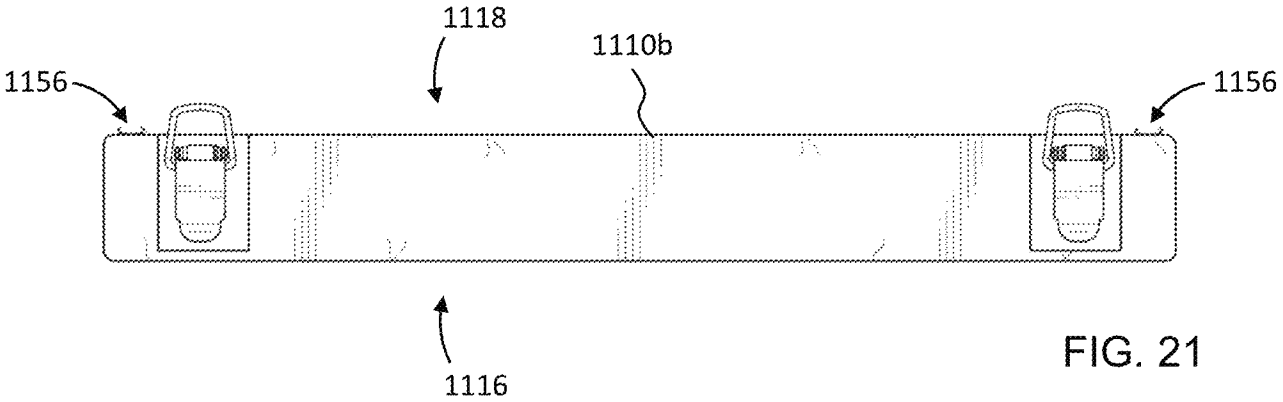
FIG. 21 is a bottom view of the arm portion of FIG. 20.

Referring to FIG. 16, in the example illustrated, the second arm 1110*b* has a second outboard side 1116 directed away from the seating assembly 1102, and a second inboard side 1118 laterally opposite the second outboard side 1116 and directed toward the seating assembly 1102. In the example illustrated, the second inboard side 1118 includes a plurality of second arm connectors 1156 (FIG. 20). Each second arm connector 1156 (FIG. 20) and a corresponding second end connector 1106 define a second pair of interlockable connectors for removably attaching the second arm 1110*b* to the second end 1102*b* of the seating assembly 1102. In the example illustrated, the second inboard side 1118 of the second arm 1110*b* includes two of the second arm connectors 1156 (FIG. 20) and the second end 1102*b* of the seating assembly 1102 includes two corresponding second end connectors 1106, defining two second pairs of interlockable connectors for removably attaching the second arm 1110*b* to the second end 1102*b*. One second pair of the interlockable connectors is adjacent the front of the seating assembly 1102 and the other second pair of interlockable connectors is adjacent the rear of the seating assembly 1102.

Referring to FIG. 15, the seating assembly 1102 includes at least one seat section 1120 for supporting the body of a user. In the example illustrated, the seating assembly 1102 includes a plurality of the seat sections 1120 removably attachable to each other in a sofa arrangement. In the example illustrated, the seating assembly 1102 includes three seat sections 1120: a first seat section 1120*a* defining the first end 1102*a* of the seating assembly 1102 (and removably attachable to the first arm 110*a*), a second seat section 1120*b* laterally opposite the first seat section 1120*a* and defining the second end 1102*b* of the seating assembly

1102 (and removably attachable to the second arm 1110*b*), and a third seat section 1120*c* between and removably attachable to the first and second seat sections 1120*a*, 1120*b*.

Referring to FIG. 16, in the example illustrated, each seat section 1120 has a first side 1121*a* and a second side 1121*b* laterally opposite the first side 1121*a*. In the example illustrated, the first side 1121*a* of the first seat section 1120*a* defines the first end 1102*a* of the seating assembly 1102 and the second side 1121*b* of the second seat section 1120*b* defines the second end 1102*b* of the seating assembly 1102. In the example illustrated, the seat sections 1120 are identical to each other for interchangeability therebetween, so that any one of the seat sections 1120 can be positioned to define the first end 1102*a* (attachable to the first arm 1110*a*) or the second end 1102*b* (attachable to the second arm 1110*b*) of the seating assembly 1102.

Figure 22:
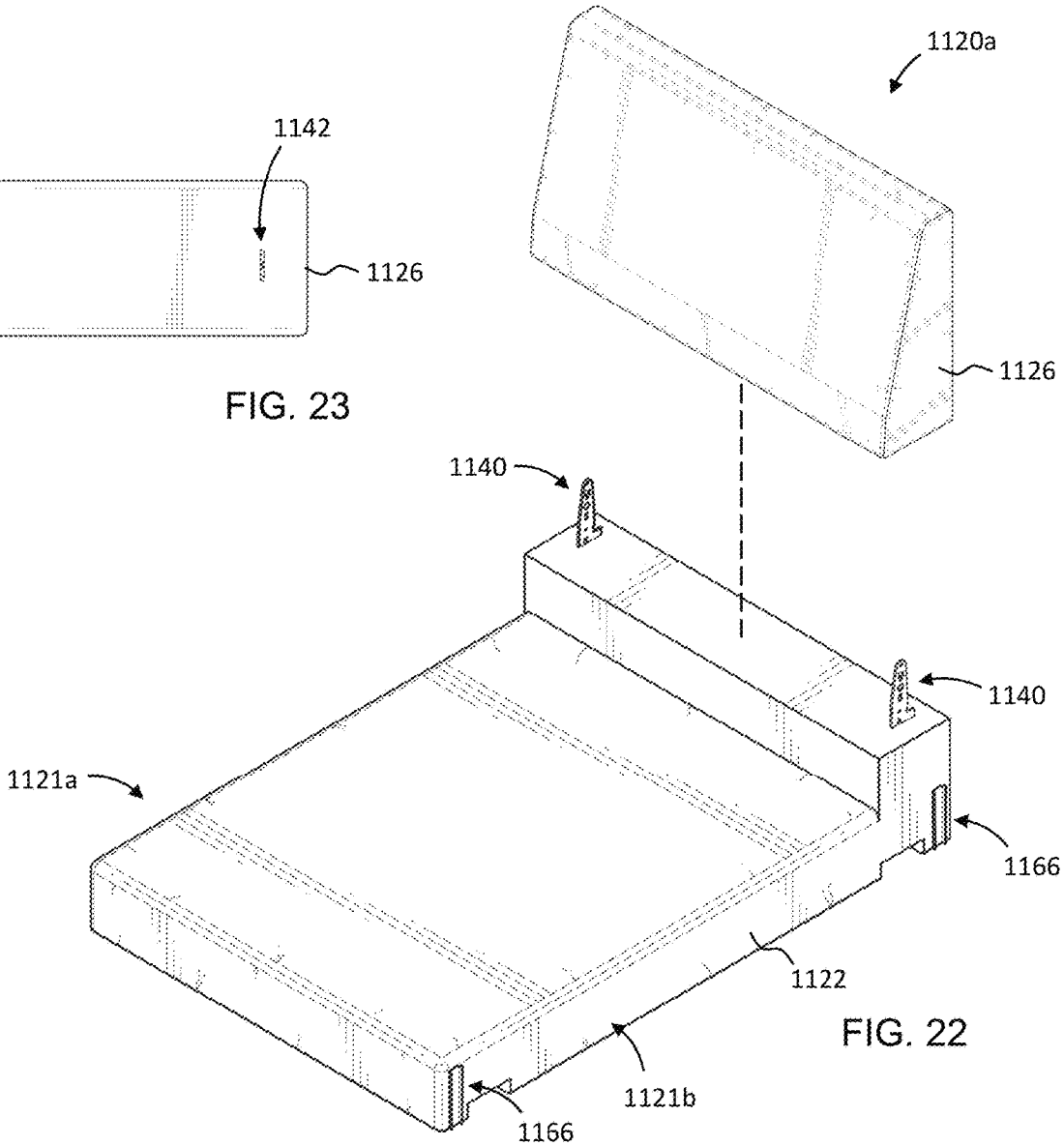
FIG. 22 is an exploded perspective view of an example seat section of the furniture assembly of FIG. 15.
Figure 25:
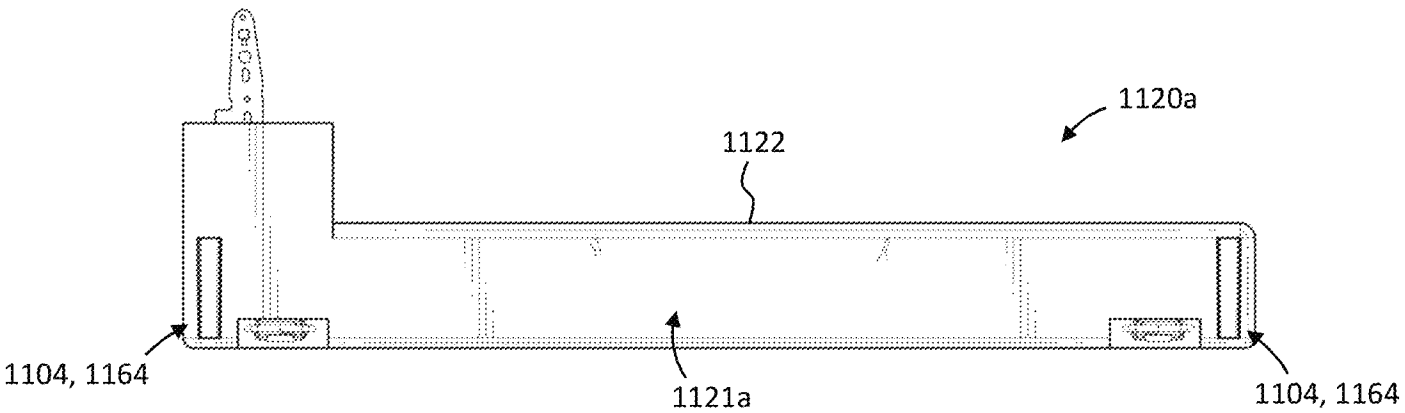
FIG. 25 is a side view from an opposite side of the base portion of FIG. 24.
Figure 26:
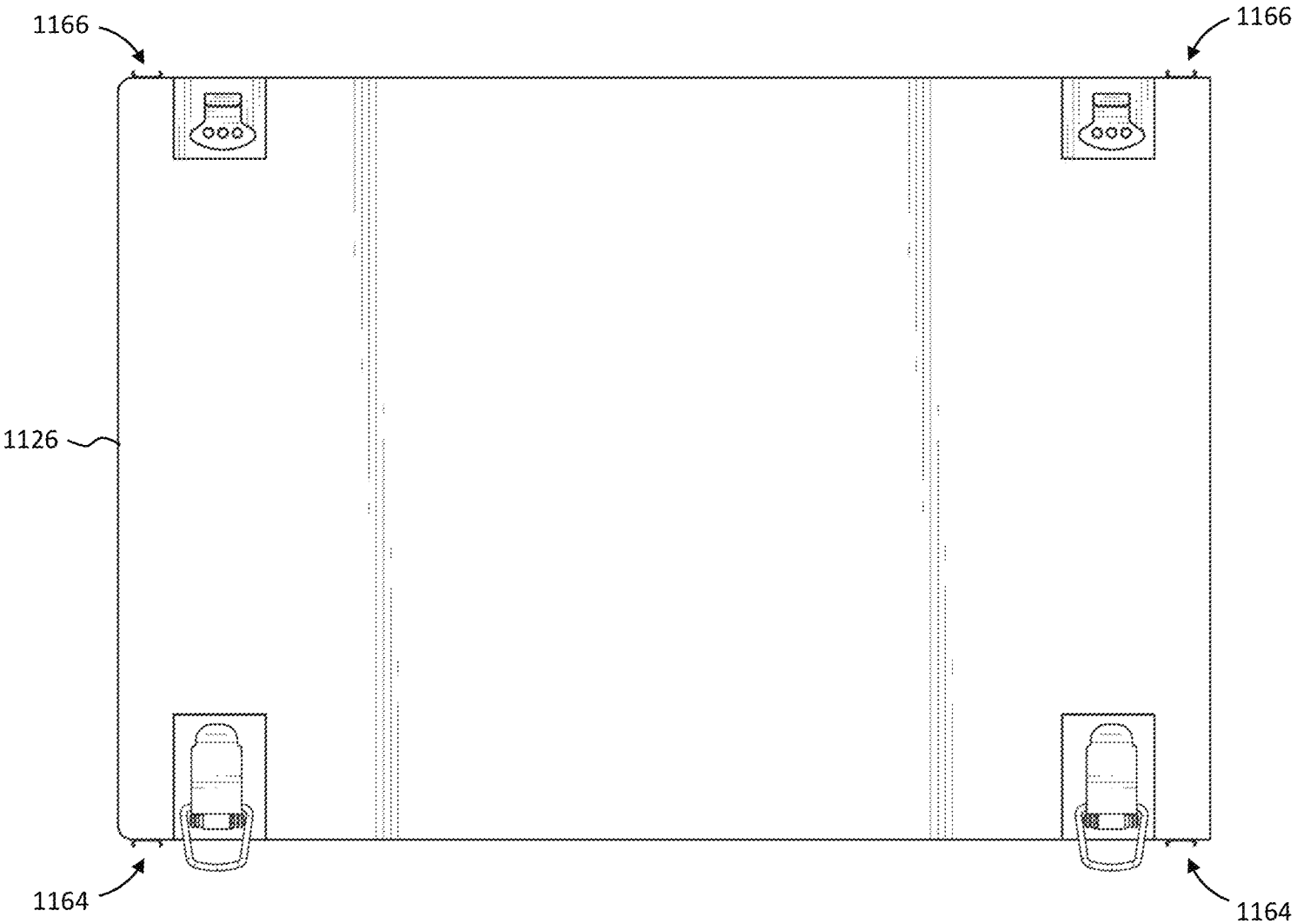
FIG. 26 is a bottom view of the base portion of FIG. 24.

Referring to FIG. 22, In the example illustrated, the first side 1121*a* of each seat section 1120 includes a plurality of first side connectors 1164 (FIG. 25) and the second side 1121*b* of each seat section 1120 includes a plurality of second side connectors 1166. Each first side connector 1164 (FIG. 25) of the seat section 1120 is interlockable with a corresponding second side connector 1166 of an adjacent seat section 1120 to define a third pair of interlockable connectors for removably attaching adjacent seat sections 1120 to each other. Referring to FIG. 25, in the example illustrated, the first side connectors 1164 of the first seat section 1120*a* define the first end connectors 1104 for attaching the first arm 1110*a* to the seating assembly 1102. Referring to FIG. 16, the second side connectors 1166 of the second seat section 1120*b* define the second end connectors 1106 for attaching the second arm 1110*b* to the seating assembly 1102.

Referring to FIGS. 27 to 30, in the example illustrated, each of the first, second, and third pair of interlockable connectors comprises a first female bracket 1200*f* and a first male bracket 1200*m* slidable into the first female bracket 1200*f* for interlocking thereof. In the example illustrated, the first male and female brackets 1200*m*, 1200*f* of the first pair of interlockable connectors are identical to the first male and female brackets 1200*m*, 1200*f* of the second pair of interlockable connectors and of the third pair of interlockable connectors to facilitate interchangeability of the seat sections 1120.

In the example illustrated, each first female bracket 1200*f* defines a first bracket channel 1202 extending along a first channel axis 1204 oriented generally vertically when the furniture assembly 1100 is upright. Each first male bracket 1200*m* comprises a first slide member 1206 slidable into the first bracket channel 1202 generally along the first channel axis 1204 for interlocking thereof to inhibit horizontal movement therebetween. The channel axis 1204 can be oriented at, for example, 60 to 120 degrees from horizontal when the furniture assembly 1100 is upright to facilitate insertion of the slide member 1206 into the bracket channel 1202 in a generally vertical direction. In the example illustrated, the first channel axis 1204 is oriented at about 90 degrees from horizontal when the furniture assembly 1100 is upright. In the example illustrated, the first bracket channel 1202 extends along the channel axis 1204 between a channel first end 1207 and a channel second end 1208 opposite the first end 1207. The first end 1207 of the first bracket channel 1202 defines a first channel opening 1210 oriented generally normal to the channel axis 1204 and through which the slide member 1206 is insertable into the bracket channel 1202.

In the example illustrated, the first male and female brackets 1200*m*, 1200*f* are tapered to facilitate nesting of the male bracket 1200*m* in the bracket channel, which can facilitate a close, tight fit between the brackets 1200*m*, 1200*f*. In the example illustrated, the first bracket channel 1202 has a first channel length extending along the first channel axis 1204 and a first channel width tapering along the channel length at a first taper angle, with the first end 1207 of the bracket channel 1202 being wider relative to the second end 1208. The first slide member 1206 has a first slide member length and a first slide member width tapering along the slide member length at a second taper angle corresponding to the first taper angle to facilitate nesting of the first slide member 1206 in the first bracket channel 1202. In the example illustrated, the first slide member 1206 extends along its length between a slide member first end 1224 for insertion into the channel opening 1210 and a slide member second end 1226 opposite the first end. The slide member first end 1224 is narrower relative to the slide member second end 1226.

Referring to FIG. 30, in the example illustrated, the first female bracket 1200*f* has a generally C-shaped cross section (taken normal to the channel axis 1204) defining the bracket channel 1202, and the first male bracket 1200*m* has a generally C-shaped cross section (taken normal to the channel axis 1204) corresponding to that of the first female bracket 1200*f* and defining the slide member 1206. In the example illustrated, each of the first female bracket 1200*f* and the first male bracket 1200*m* has a mount plate 1230*f*, 1230*m* extending lengthwise along the first channel axis 1204 and widthwise between opposed edges of the mount plate 1230*f*, 1230*m*. The mount plate 1230*f*, 1230*m* of each bracket 1200*f*, 1200*m* has a plurality of mounting holes for attaching the brackets to corresponding furniture components using fasteners. Each of the female and male brackets 1230*f*, 1230*m* further has a pair of retaining flanges 1232*f*, 1230*m* projecting from the opposed edges generally perpendicular to the mount plate 1230*f*, 1230*m*. The flanges 1230*m* of the first male bracket 1200*m* are sized and shaped to be retained by the flanges 1232*f* of the first female bracket 1200*f* in close fit when the first male bracket 1200*m* is seated in the bracket channel 1202.

Figure 23:
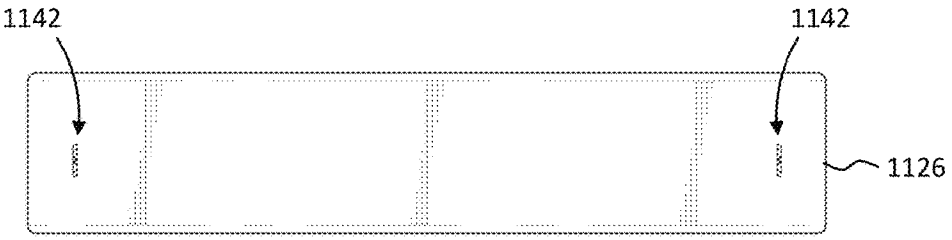
FIG. 23 is a bottom view of a back portion of the seat section of FIG. 22.

Referring to FIG. 22, in the example illustrated, each seat section 1120 includes a seat base 1122 having a front, a rear opposite the front, and a plurality of rear connectors 1140 adjacent the rear. Each seat section 1120 further includes a seat back 1124 having a top, a bottom vertically opposite the top, and a plurality of bottom connectors 1142 (FIG. 23) adjacent the bottom. Each bottom connector 1142 (FIG. 23) and a corresponding rear connector 1140 (FIG. 22) define a fourth pair of interlockable connectors for removably attaching the seat back 1124 to the seat base 1122 to form the seat section 1120.

Figure 31:
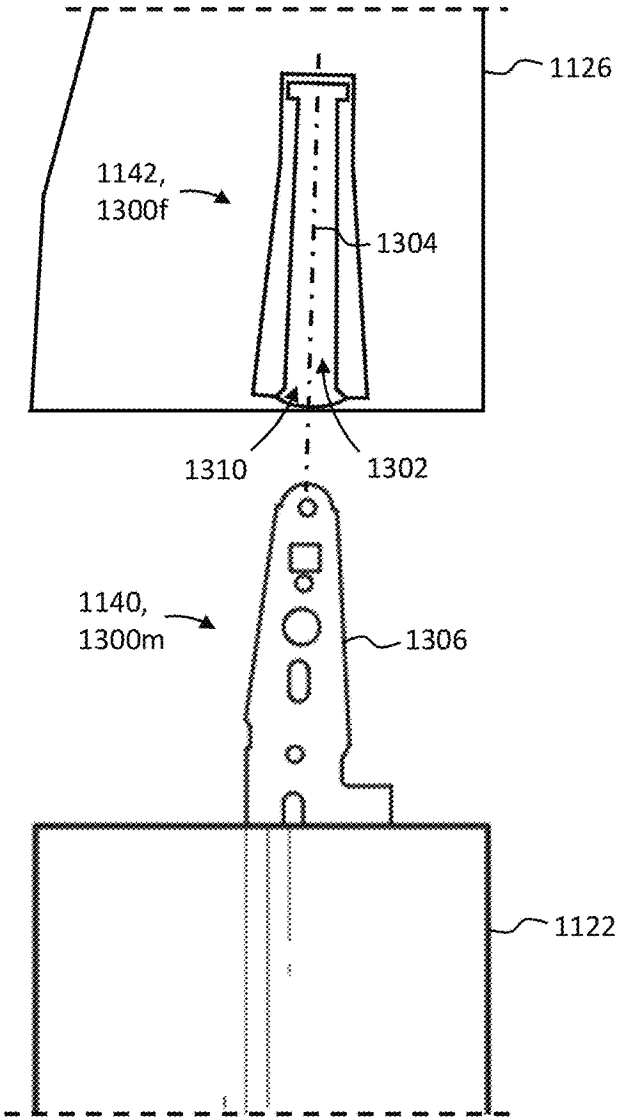
FIG. 31 is a schematic side view showing a lower end of the back portion of FIG. 23 and an upper rear of the base portion of FIG. 24.

Referring to FIG. 31, in the example illustrated, each fourth pair of interlockable connectors comprises a second female bracket 1300*f* and a second male bracket 1300*m* slidable into the female bracket 1300*f* for interlocking thereof. In the example illustrated, each second female bracket 1300*f* defines a second bracket channel 1302 extending along a second channel axis 1304 oriented generally vertically when the furniture assembly 1100 is upright. Each second male bracket 1300*m* comprises a second slide member 1306 slidable into the bracket channel 1302 generally along the second channel axis 1304 for interlocking thereof to inhibit horizontal movement therebetween. The channel axis 1304 can be oriented at, for example, 60 to 120 degrees from horizontal when the furniture assembly 1100 is upright to facilitate insertion of the slide member 1306 into the bracket channel 1302 in a generally vertical direction. In the example illustrated, the channel axis 1304 is oriented between about 80 and 90 degrees from horizontal when the furniture assembly 1100 is upright. In the example illustrated, the bracket channel 1302 extends along the channel axis 1304 between a channel first end and a channel second end opposite the first end. The first end defines a channel opening 1310 oriented generally normal to the channel axis 1304 for insertion of the slide member 1306 into the bracket channel 1302.

In the example illustrated, the second male and female brackets 1300*m*, 1300*f* are tapered to facilitate nesting of the second male bracket 1300*m* in the second bracket channel 1302, which can facilitate a close, tight fit between the brackets 1300*m*, 1300*f*. In the example illustrated, the second bracket channel 1304 has a second channel length extending along the channel axis and a second channel width tapering along the channel length at a third taper angle, and the first end (defining the opening 1310) of the bracket channel 1302 is wider relative to the second end. The second slide member 1306 has a slide member length and a slide member width tapering along the slide member length at a fourth taper angle corresponding to the third taper angle to facilitate nesting of the second slide member in the second bracket channel 1302. In the example illustrated, the second slide member 1306 extends along its length between a slide member first end for insertion into the channel opening 1310 and a slide member second end opposite the first end. The slide member first end of the second slide member 1306 is narrower relative to the slide member second end of the second slide member 1306.

Figure 24:
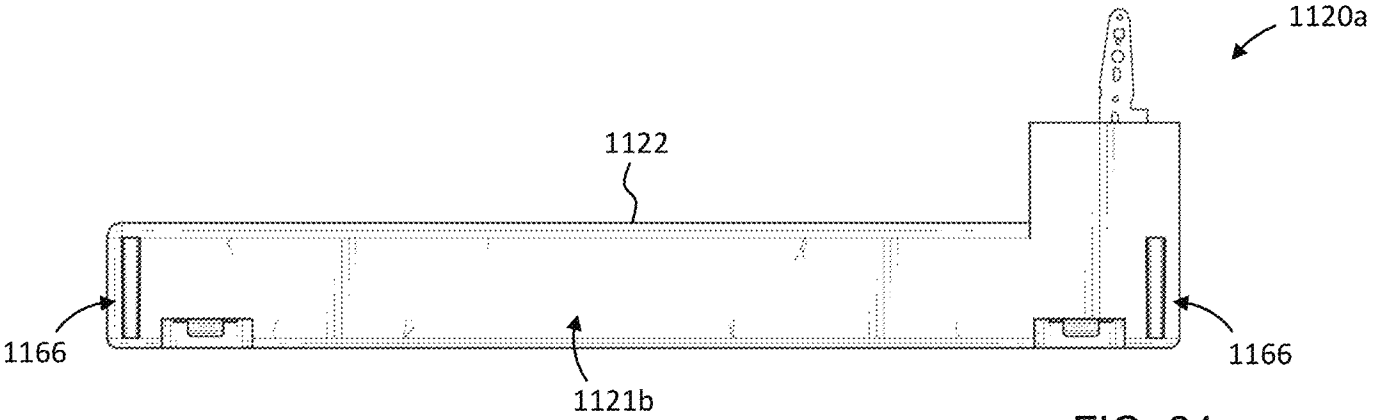
FIG. 24 is a side view from one side of a base portion of the seat section of FIG. 22.

Referring to FIGS. 24 and 25, in the example illustrated, the first and second side connectors 1164, 1166 of each seat section 1120 are fixed to the seat base 1122, and the seat back 1124 (FIG. 22) is free of any of the first and second side connectors 1164, 1166.

Figure 32:
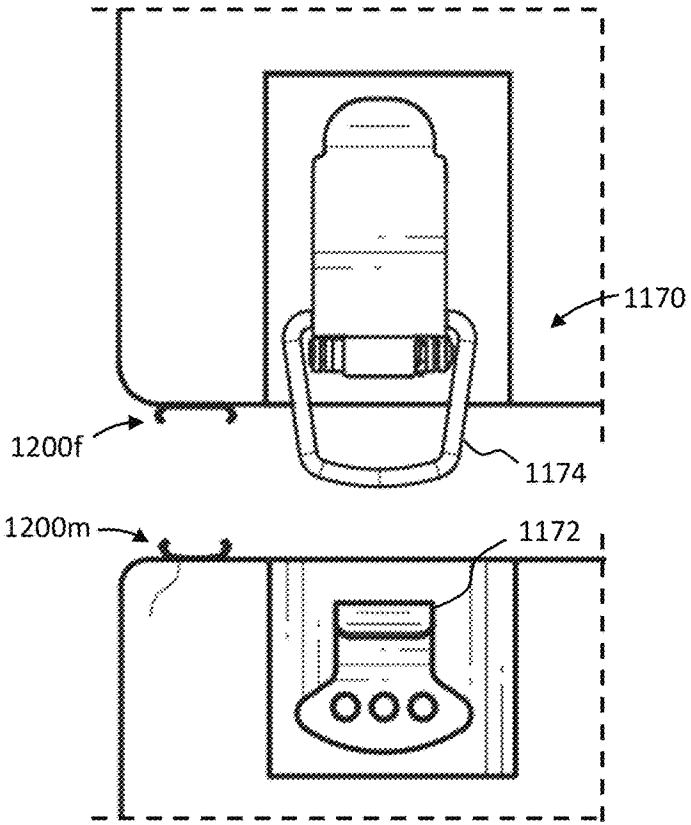
FIG. 32 is a bottom view of an example latch mechanism of the furniture assembly of FIG. 15.

Referring to FIG. 32, in the example illustrated, the furniture assembly 1100 includes a plurality of latch mechanisms 1170 for pulling together and latching pairs of the furniture components, including the first arm 1110*a* to the first end 1102*a* of the seating assembly 1102, the second arm 1110*b* to the second end 1102*b* of the seating assembly 1102, and each seat section 1120 to an adjacent seat section 1120. In the example illustrated, each latch mechanism 1170 comprises a draw latch including a keeper portion 1172 fixed to an underside of one of the furniture components and a clasp portion 1174 fixed to an underside of the other one of the furniture components and engageable with the keeper portion 1172 for pulling together the furniture components.

In the example illustrated, the furniture assembly 1100 includes a corresponding pair of latch mechanisms 1170 at the interface between the first arm 1110*a* and the first end 1102*a* of the seating assembly 1102, at the interface between the second arm 1110*b* and the second end 1102*b* of the seating assembly 1102, and at the interface between each pair of adjacent seat sections 1120. Each pair of latch mechanisms 1170 includes one latch mechanism adjacent the front of the seating assembly 1102 and the other latch mechanism adjacent a rear of the seating assembly 1102.

One of the keeper portion 1172 and the clasp portion 1174 can be fixed to the first arm 1110*a* adjacent the inboard side 1114 and to each seat section 1120 adjacent the second side 1121*b*, and the other one of the keeper portion 1172 and the clasp portion 1174 can be fixed to the second arm 1110*b* adjacent the second inboard side 1118 and to each seat section 1120 adjacent the first side 1121*a*, which can facilitate interchangeability of the seat sections 1120.

Referring to FIG. 16, in the example illustrated, a plurality of legs 1600 are attachable to an underside of corresponding furniture components to support the furniture components above a ground surface. In the example illustrated, the legs 1600 are attachable to the furniture components through corresponding leg plates 1400, 1600 mountable to the underside of the furniture components.

The invention claimed is:

1. A kit of parts shippable to an end user in a plurality of boxes for assembly of the parts by the end user into seating furniture, the kit pf parts including:

a) a plurality of seat bases, each seat base having a seat base first side and a seat base second side spaced laterally apart from the seat base first side, each seat base first side having at least one slide connector of a plurality of slide connectors secured thereto, each seat base second side having at least one channel connector of a plurality of channel connectors secured thereto, and each seat base having an upwardly protruding portion at a rear of the seat base defining a raised upper surface, the raised upper surface of each seat base including a plurality of rear connectors;

b) a plurality of seat backs equal in quantity to the plurality of seat bases, each of the seat backs having a top, a bottom vertically opposite the top, and a plurality of bottom connectors adjacent the bottom and alignable with the plurality of rear connectors of any one of the plurality of seat bases for removably attaching the seat backs to the seat bases;

c) a first armrest with at least another channel connector of the plurality of channel connectors secured thereto, each channel connector of the first armrest comprising a first channel for slidably receiving a first slide member of a respective slide connector of any first seat base of the plurality of seat bases for securing the first armrest and the first seat base together;

d) a second armrest with at least another slide connector of the plurality of slide connectors secured thereto, each slide connector of the second armrest comprising a second slide member for slidable insertion into a second channel of a respective channel connector of any second seat base of the plurality of seat bases for securing the second armrest and the second seat base together;

e) wherein each channel connector secured to the first seat base comprises a third channel for slidably receiving a third slide member of a respective slide connector of any other seat base of the plurality of seat bases for securing together said other seat base and the first seat base; and the kit of parts further comprising:

f) a plurality of latch mechanisms each movable between unlatched and latched positions, the plurality of latch mechanisms including a plurality of first latch mechanisms for laterally urging together the first armrest and the first seat base when in the latched position, and a plurality of second latch mechanisms for laterally urging together the second armrest and the second seat base when in the latched position, and wherein each first latch mechanism includes a keeper fixed to the first armrest and a clasp fixed to the first side of the first seat base, and wherein each second latch mechanism includes another keeper fixed to the second side of the second seat base and another clasp fixed to the second armrest, each clasp movable relative to the respective keeper of each latch mechanism between unlatched and latched positions, each latch mechanism exerting a lateral clamping force urging the respective seat section and respective armrest together when the clasp is in the latched position.

2. The kit of parts of claim 1, wherein the plurality of seat bases consists of the first seat base and the second base, the third slide member defined by the at least one slide connector secured to the first side of the second seat base and slidably receivable in the third channel for securing together the second seat base and the first seat base.

3. The kit of parts of claim 1, wherein the plurality of seat bases includes a third seat base, the third slide member defined by the at least one slide connector secured to the first side of the third seat base and slidably receivable in the third channel for securing together the third seat base and the first seat base.

4. The kit of parts of claim 3, wherein the plurality of seat bases consists of the first, second, and third seat bases, and wherein each channel connector that is secured to the second side of the third seat base comprises a fourth channel, and each slide connector that is secured to the first side of the second seat base comprises a fourth slide member, the fourth slide member receivable in the fourth channel for securing together the third seat base and the second seat base.

5. The kit of parts of claim 1, wherein the channel of each channel connector is oriented generally vertically when the assembled seating furniture is upright for use.

6. The kit of parts of claim 1, wherein the seat bases are identical to one another such that each seat base can be assembled in any position between the first and second armrests to facilitate assembly.

7. A knock-down furniture assembly comprising:

a) a seating assembly having a first end and a second end laterally opposite the first end, the first end including a plurality of first end connectors and the second end including a plurality of second end connectors, b) a first arm having a first outboard side and a first inboard side laterally opposite the first outboard side, the first inboard side including a plurality of first arm connectors, each first arm connector and a corresponding first end connector defining a first pair of interlockable connectors for removably attaching the first arm to the first end of the seating assembly; and c) a second arm having a second outboard side and a second inboard side laterally opposite the second outboard side, the second inboard side including a plurality of second arm connectors, each second arm connector and a corresponding second end connector defining a second pair of interlockable connectors for removably attaching the second arm to the second end of the seating assembly; and d) a plurality of latch mechanisms each movable between unlatched and latched positions, the plurality of latch mechanisms including a first latch mechanism for laterally urging together the first arm and the first end of the seating assembly when in the latched position, and a second latch mechanism for laterally urging together the second arm and the second end of the seating assembly when in the latched position, and wherein the first latch mechanism includes a keeper fixed to the first arm and a clasp fixed to the first end of the seating assembly, and wherein the second latch mechanism includes another keeper fixed to the second end of the seating assembly and another clasp fixed to the second arm, each clasp movable relative to the respective keeper of each latch mechanism between unlatched and latched positions, each latch mechanism exerting a lateral clamping force urging the respective seating assembly end and respective arm together when the clasp is in the latched position.

8. The knock-down furniture assembly of claim 7, wherein the seating assembly comprises a plurality of modular seat sections removably attachable to each other in a sofa arrangement, each seat section having a first side and a second side laterally opposite the first side, the first side of a first one of the seat sections defining the first end of the seating assembly and the second side of a second one of the seat sections defining the second end of the seating assembly.

9. The knock-down furniture assembly of claim 8, wherein the seat sections are identical to each other to facilitate interchangeability therebetween.

10. The knock-down furniture assembly of claim 8, wherein the first side of each seat section includes a plurality of first side connectors and the second side of each seat section includes a plurality of second side connectors, each first side connector of any seat section interlockable with a corresponding second side connector of an adjacent seat section to define a third pair of interlockable connectors for removably attaching adjacent seat sections to each other.

11. The knock-down furniture assembly of claim 10, wherein the first end connectors for attaching the first arm to the seating assembly comprise the first side connectors of the first one of the seat sections, and the second end connectors for attaching the second arm to the seating assembly comprise the second side connectors of the second one of the seat sections.

12. The knock-down furniture assembly of claim 10, wherein each seat section includes: (i) a seat base having a front, a rear opposite the front, and a plurality of rear connectors adjacent the rear; and (ii) a seat back having a top, a bottom vertically opposite the top, and a plurality of bottom connectors adjacent the bottom, each bottom connector and a corresponding rear connector defining a fourth pair of interlockable connectors for removably attaching the seat back to the seat base to form the seat section.

13. The knock-down furniture assembly of claim 12, wherein the first and second side connectors of each seat section are on the seat base and the seat back is free of any of the first and second side connectors.

14. The knock-down furniture assembly of claim 7, wherein each pair of interlockable connectors comprises (i) a channel connector defining a bracket channel extending along a channel axis oriented generally vertically when the furniture assembly is upright, and (ii) a slide connector comprising a slide member slidable into the bracket channel generally along the channel axis for interlocking thereof.

15. The knock-down furniture assembly of claim 14, wherein closing the first latch mechanism pulls the first arm and the first end of the seating assembly together along a first latch axis that is generally perpendicular to the channel axis and wherein closing the second latch mechanism pulls the second arm and the second end of the seating assembly together along a second latch axis that is generally perpendicular to the channel axis.

16. The knock-down furniture assembly of claim 15, wherein upon closing the latch mechanisms, laterally adjacent surfaces of the channel connector and the slide connector of each pair of interlockable connectors are pressed firmly against each other.

17. The knock-down furniture assembly of claim 14, wherein the bracket channel extends along the channel axis between a first channel end and a second channel end opposite the first channel end, the first channel end defining a channel opening oriented normal to the channel axis for insertion of the slide member into the bracket channel.

18. The knock-down furniture assembly of claim 14, wherein the bracket channel has a channel length extending along the channel axis and a channel width tapering along the channel length at a first taper angle, and the slide member has a slide member length and a slide member width tapering along the slide member length at a second taper angle corresponding to the first taper angle for nesting of the slide member in the bracket channel.

19. Knock-down furniture assembly of claim 14, wherein the channel and slide connectors of the first pair of interlockable connectors are identical to the channel and slide connectors of the second pair of interlockable connectors.

20. A knock-down furniture assembly, comprising:

a) a seating assembly having a first end and a second end laterally opposite the first end, the first end including a first end connector and the second end including a second end connector;

b) a first arm having a first outboard side and a first inboard side laterally opposite the first outboard side, the first inboard side including a first arm connector, the first arm connector and the first end connector defining a first pair of interlockable connectors for removably attaching the first arm to the first end of the seating assembly;

c) a second arm having a second outboard side and a second inboard side laterally opposite the second outboard side, the second inboard side including a second arm connector, the second arm connector and the second end connector defining a second pair of interlockable connectors for removably attaching the second arm to the second end of the seating assembly, wherein each pair of interlockable connectors comprises (i) a channel connector defining a channel extending along a channel axis oriented generally vertically when the furniture assembly is upright, and (ii) a slide connector comprising a slide member slidable into the channel generally along the channel axis for interlocking thereof; and d) a plurality of latch mechanisms for securing the first and second arm in attached condition to the seating assembly, each latch mechanism including a keeper and a clasp movable relative to the keeper between open and closed positions corresponding to unlatched and latched positions of the latch;

wherein two first keepers of a first pair of the latch mechanisms are fixed to the first arm and two first clasps of the first pair of latch mechanisms are fixed to the first end of the seating assembly, and two second clasps of a second pair of the latch mechanisms are fixed to the second arm and two second keepers of the second pair of latch mechanisms are fixed to the second end of the seating assembly; and wherein moving the first clasps and the second clasps to the closed position pulls the first arm and the second arm toward the first end and second end of the seating assembly, respectively, along respective latch axes that are generally perpendicular to the channel axis.

21. The knock-down furniture assembly of claim 20, wherein upon closing the latch mechanisms, laterally adjacent surfaces of the channel connector and the slide connector of each pair of interlockable connectors are pressed firmly against each other.

* * * * *